US005855475A

United States Patent [19]

Fujio et al.

[11] Patent Number: 5,855,475

[45] Date of Patent: Jan. 5, 1999

[54] SCROLL COMPRESSOR HAVING BYPASS VALVES

[75] Inventors: Katsuharu Fujio, Shiga-ken; Kiyoshi Sano, Otsu; Takashi Morimoto, Nagaokakyo; Syozo Hase, Hikone; Shuichi Yamamoto, Otsu; Kiyoshi Sawai, Otsu; Hiromasa Ashitani, Otsu; Sadayuki Yamada, Otsu, all of Japan

[73] Assignee: Matsushita Electric Industrial Co., Ltd., Osaka, Japan

[21] Appl. No.: 761,085

[22] Filed: Dec. 4, 1996

[30] Foreign Application Priority Data

| | | | |
|---|---|---|---|
| Dec. 5, 1995 | [JP] | Japan | 7-316256 |
| Dec. 21, 1995 | [JP] | Japan | 7-332992 |
| Feb. 14, 1996 | [JP] | Japan | 8-026393 |
| Feb. 14, 1996 | [JP] | Japan | 8-026394 |
| Feb. 14, 1996 | [JP] | Japan | 8-026395 |

[51] Int. Cl.[6] ..... F04C 18/04; F04C 29/08

[52] U.S. Cl. ..... 418/15; 418/55.1

[58] Field of Search ..... 418/15, 55.1

[56] References Cited

U.S. PATENT DOCUMENTS

| | | | |
|---|---|---|---|
| 4,650,405 | 3/1987 | Iwanami et al. | 418/5 |
| 5,674,058 | 10/1997 | Matsuda et al. | 418/15 |

FOREIGN PATENT DOCUMENTS

| | | | |
|---|---|---|---|
| 58-128485 | 8/1983 | Japan . | |
| 63-140884 | 6/1988 | Japan . | |
| 1-106987 | 4/1989 | Japan | 418/15 |
| 3-233181 | 10/1991 | Japan . | |

*Primary Examiner*—John J. Vrablik

*Attorney, Agent, or Firm*—Wenderoth, Lind & Ponack, L.L.P.

[57] ABSTRACT

A scroll compressor has a check valve assembly for selectively opening and closing a discharge port and allowing a fluid to flow only from the discharge port towards a discharge chamber. A stationary end plate mounted in the scroll compressor has a plurality of bypass holes defined therein at locations symmetrical in terms of pressure. The plurality of bypass holes are open to compression chambers closest to the discharge port and communicate with the discharge chamber. The stationary end plate also has at least one bypass valve for selectively opening and closing the bypass holes and allowing the fluid to flow only from the compression chambers towards the discharge chamber through the bypass holes. The bypass holes are serviceable to prevent an excessive compression and are positioned so as not to be closed by an orbiting scroll wrap immediately after the compression chambers closest to the discharge port have communicated with the discharge port.

27 Claims, 23 Drawing Sheets

SCROLL COMPRESSOR HAVING BYPASS VALVES

BACKGROUND OF THE INVENTION

1. Field of the Invention

The present invention relates generally to a scroll compressor and, more particularly, to a disposition of bypass holes and bypass passages defined in the scroll compressor and that of bypass valves mounted therein.

2. Description of Related Art

In a scroll compressor of a kind having a low vibration and a low noise emission, a suction chamber and a discharge port are defined radially outwardly of and centrally of scroll wraps forming a plurality of compression chambers therebetween, respectively, and a compression ratio determined by the volume of the suction chamber and the volume of the final compression chamber is fixed.

Particularly where variation in operating compression ratio determined by the suction pressure and the discharge pressure is small, a highly-efficient compression is possible with no need to use any discharge valve device such as employed in a reciprocating piston-type compressor or a rotary compressor for compressing a fluid medium, provided that the volume ratio of the compression chamber is determined consistently.

Where the scroll compressor is used in an air conditioner for compressing a refrigerant, the suction and discharge pressure of the refrigerant vary with changes in load on the air-conditioner and variable speed operations.

By the effect of a difference between the operating compression ratio and the preset compression ratio, the scroll compressor may suffer from insufficient compression or excessive compression. In the event of the insufficient compression, a high pressure refrigerant gas inside a discharge chamber may intermittently flow back from the discharge port into the compression chambers, accompanied by an increase of compression inputs.

Also, in the event that a liquid refrigerant or a substantial amount of lubricating oil is compressed, that is, in the event of occurrence of a so-called liquid compression phenomenon, the scroll compressor is held in a super compression condition, accompanied by not only an abnormal increase in compression inputs, but also excessive vibration to such an extent as to result in generation of noise and damage to the compressor.

In order to avoid any possible back-flow of the compressed fluid medium resulting from the insufficient compression, the use has been suggested of a check valve device 1074 such as disclosed in, for example, U.S. Pat. No. 4,650,405 and shown in FIG. 1. Referring to FIG. 1, the check valve device 1074 includes a check valve member 1076 generally in the form of a reed valve and a valve retainer 1078 both disposed in the proximity of an exit end of the discharge port 1072 defined at the center of a stationary scroll 1058.

For lessening the excessive compression, the following three bypass means are known for selectively opening and closing a communication between the compression chamber and the discharge port.

Referring to FIGS. 2, 3 and 4A–4D, there is shown the bypass means such as disclosed in Japanese Laid-open Patent Publication (unexamined) No. 3-233181. This bypass means includes a stationary scroll 1102 formed with first bypass holes 1117*a* and 1117*b* and second bypass holes 1118*a* and 1118*b* both defined therein in symmetrical relation with each other for discharging a fluid medium between two symmetrical compression chambers 1106 and an internal high pressure space within the sealed vessel 1101. The bypass means also includes a bypass valve device 1115 in the form of a reed valve for selectively opening and closing the exit end of each of the bypass holes 1117*a*, 1117*b*, 1118*a* and 1118*b* by the effect of the pressure difference.

According to the bypass means disclosed in Japanese publication No. 3-233181, when an abnormal increase in pressure occurs inside the compression chambers 1106 as a result of occurrence of the excessive compression and/or the liquid compression inside the compression chambers 1106, air being compressed can be discharged directly to the high pressure space inside the sealed vessel 1101.

As a result thereof, the pressure inside the compression chambers 1106 abruptly decreases to avoid any possible rupture of the compressor.

As shown in FIGS. 4A to 4D, the first bypass holes 1117*a* and 1117*b* and the second bypass holes 1118*a* and 1118*b* are disposed in the manner which will now be described.

When an orbiting scroll 1103 is held at an orbiting angle in which the first bypass holes 1117*a* and 1117*b* positioned radially outwardly relative to the second bypass holes 1118*a* and 1118*b* are closed by a free end face of the orbiting scroll 1103, the second bypass holes 1118*a* and 1118*b* are opened as shown in FIG. 4A. On the other hand, when the orbiting scroll 1103 is held at an orbiting angle in which the compression chamber 1106 closest to the discharge port 1128 communicates with the discharge port 1128, the second bypass holes 1118*a* and 1118*b* positioned radially inwardly relative to the first bypass holes 1117*a* and 1117*b* are closed by the free end face of the orbiting scroll 1103, as shown in FIG. 4D.

Thus, according to the arrangement shown in FIGS. 2, 3 and 4A–4D, the second bypass holes 1118*a* and 1118*b* perform no function when the compression chambers 1106 communicate with the discharge port 1128.

The other, second and third bypass means are disclosed in Japanese Laid-open Patent Publications (unexamined) No. 58-128485 and No. 63-140884, respectively.

According to the second bypass means, bypass holes are defined in communication with compression chambers which are normally closed without being communicated with any of the suction chamber and the discharge port. In this known system, the bypass holes are defined in communication with the normally closed compression chambers, because in the event of occurrence of an excessive compression within such compression chambers the compressor may be detrimentally damaged.

The third bypass means such as disclosed in Japanese publication No. 63-140884 referred to above makes use of bypass holes that are not intended to avoid the abnormal increase in pressure which would occur at the time of liquid compression. Such bypass holes are merely provided for lessening a slight excessive compression occurring during the final stage of compression when the operating compression ratio of the scroll compressor is smaller than the preset compression ratio. Accordingly, the bypass holes are defined at locations sufficient to allow the scroll compressor to exhibit a compression ratio of about 0.5 to 0.75 relative to the preset compression ratio.

However, the prior art bypass means have been found to have the following problems.

In the first place, since even when the operating compression ratio matches substantially with the preset compression ratio, the sectional area of a passage is small immediately after communication between the compression chambers and the discharge port, and an excessive compression does undesirably take place within the compression chambers after the compression.

In addition, the check valve member 1076 shown in FIG. 1 is apt not to open under the influence of an inertia force of the spring, resulting in delay in operation. As a result thereof, an excessive compression also occurs within the discharge port 1072. Specifically, during a high speed operating condition of the compressor, a considerable excessive compression takes place not only inside the compression chambers closest to the discharge port 1072, but also inside the discharge port 1072, accompanied by an increase in compression inputs. Where the operating compression ratio is lower than the preset compression ratio (that is, during the operating condition in which the excessive compression occurs), compression input losses will increase as well.

Accordingly, it is clear that the first to third bypass means discussed above, which have been tailored to minimize problems which would occur during the operating condition in which the excessive compression takes place, are ineffective to eliminate the occurrence of the excessive compression which occurs immediately after the compression chambers communicate with the discharge port.

In the second place, where in order to eliminate problems associated with the operating condition in which an insufficient compression takes place, the check valve member 1076 is employed as shown in FIG. 1 and, on the other hand, in order to eliminate problems associated with the operating condition in which the excessive compression takes place, the first to third bypass means (comprised of the bypass holes and the bypass valves), for example, are employed as discussed above, the check valve member 1076 may interfere with the plural bypass valves. For this reason, depending on the operating compression ratio and the preset compression ratio, the bypass holes cannot be defined at optimum locations, making it impossible to obtain an effective bypassing function.

It may, however, be contemplated to use inclined holes for the bypass holes so that the bypass valves can be separated from the check valve member 1076. However, this possibility requires a relatively long bypass holes which would result in an increase of the quantity of the compressed gas remaining within the compression chambers, accompanied by a reduction in compression efficiency which is brought about by reexpansion of the residual compressed gas within the compression chambers.

In the third place, the number of the bypass valves tends to be increased one for each of the bypass holes so that the bypass holes can be closed by the respective bypass valves. The use of the increased number of the bypass valves results in an increase of manufacturing cost and also generation of a considerable noise during selective opening and closing of the bypass valves to such an extent as to bring about a disadvantage to the scroll compressor known to have a low noise emission.

In addition, the necessity will arise that in order to eliminate the problem associated with interference between the check valve device and the bypass valves, the size of an effective area of each bypass valve which is used to close the corresponding bypass hole and that of the check valve device which is used to close the discharge port must be small. This may bring about such a disadvantage that a sealing function of the bypass valves relative to the bypass holes and that of the check valve device relative to the discharge port may be lowered unless the check valve device and the bypass valves are properly installed in the stationary scroll.

Finally, diffusion of the discharged gas which takes place during selective opening and closing of the check valve device tends to bring about a reduction in sealing effect of the bypass valves disposed in the proximity of the check valve device.

Because of the various reasons discussed above, it often occurs that the position of the bypass holes is determined in consideration of possible influence brought about by the check valve, making it difficult to properly position the bypass holes in a manner effective to obtain an effective bypassing function. Accordingly, little suggestion has been made to encourage the use of the bypass holes and the associated bypass valves in the scroll compressor wherein the check valve is installed for selectively closing and opening the discharge port.

SUMMARY OF THE INVENTION

The present invention has been devised to substantially eliminate the various problems hitherto encountered as discussed above and is designed to increase the performance exhibited during an operating condition with a low compression ratio at which the frequency of operation is high, without accompanying reduction in performance exhibited during an operating condition with a high compression ratio.

Another important object of the present invention is to provide improved bypass valves of a simplified structure effective to selectively open and close the bypass holes disposed in the proximity of the discharge port without interfering with the check valve device for selectively opening and closing the discharge port and also to increase the compression efficiency by expanding the range in which the excessive compression is reduced and also by minimizing the amount of the compressed gas remaining within the bypass holes.

A further object of the present invention is to increase the performance exhibited over a wide range from the operating condition with a high compression ratio to the operating condition with a low compression ratio by the provision of the bypass means.

A still further object of the present invention is to provide improved bypass valves capable of setting the check valve device for selectively opening and closing the discharge port in a condition ready to open in response to opening of the bypass valves and improved bypass valves capable of allowing the bypass holes to quickly open.

Another object of the present invention is to prevent any possible reduction in closing performance of both of the check valve device and the bypass valves by improving the positioning accuracy with which the check valve device and the bypass valves are installed in the stationary scroll.

In accomplishing the above and other objects, the scroll compressor of the present invention includes a stationary end plate having at least two first bypass holes defined therein at locations symmetrical in terms of pressure. The two first bypass holes are open to compression chambers closest to a discharge port and communicating with a discharge chamber. The scroll compressor also includes a check valve means for selectively opening and closing the discharge port and allowing a fluid to flow only from the discharge port towards the discharge chamber, and a bypass valve means for selectively opening and closing the first bypass holes and allowing the fluid to flow only from the compression chambers towards the discharge chamber through the first bypass holes. The first bypass holes are positioned so as not to be closed by an orbiting scroll wrap immediately after the compression chambers closest to the discharge port have communicated with the discharge port.

By this construction, because a gas is allowed to flow from the compression chambers to the discharge chamber, even if the check valve means is opened with a certain delay immediately after the compression chambers have communicated with the discharge port, the completely compressed gas is easily discharged to the discharge chamber without passing though the discharge port, thus making it possible to restrain an undesirable excessive compression and reducing compression inputs.

Advantageously, the scroll compressor further includes an oil sump defined in the closed vessel and subjected to a discharge pressure, and an oil passage means communicating the oil sump with at least one of the compression chambers and a suction chamber, wherein the first bypass holes are circumferentially positioned between the discharge port and a location where lubricating oil in the oil sump is introduced into one of the compression chambers and the suction chamber and wherein all of the plurality of compression chambers communicate intermittently with one of the discharge port and the suction chamber.

According to this construction, because the first bypass holes are filled with the lubricating oil supplied to the side lower in pressure than the first bypass holes and do not allow the gas to pass therethrough, the amount of compressed gas remaining in the compression chambers can be reduced. Accordingly, a reduction in compression efficiency which has been hitherto caused by reexpansion and recompression of the residual gas can be substantially avoided.

The stationary end plate may have at least two second bypass holes defined therein symmetrically with respect to the discharge port, with the first and second bypass holes positioned so as not to be closed simultaneously by the orbiting scroll wrap.

By this construction, because the bypass action in the compression chambers closest to the discharge port is continuously achieved, the compression inputs can be successively reduced, thus avoiding an abrupt change in compression load and restraining the occurrence of vibration when the bypass action is being achieved.

Again advantageously, a sealing member is loosely received in a scroll-shaped groove defined in a free end of the orbiting scroll wrap. If the stationary end plate also has at least two second bypass holes defined therein symmetrically with respect to the discharge port, the size and positions of the first and second bypass holes are determined so that the first and second bypass holes are not simultaneously closed by the sealing member.

By this construction, gas leakage into the neighboring compression chambers through the bypass holes, the scroll-shaped groove and the sealing member can be reduced. Furthermore, because the lubricating oil supplied to the compression chambers is easily introduced into the bypass holes by limiting the size of open ends of the bypass holes, no dead spaces exist in the compression chambers when the bypass action is not achieved. As a result, reexpansion and recompression which may be caused by movement of the gas being compressed into and out of the bypass holes do not occur, making it possible to prevent the compression efficiency from being reduced by the provision of the bypass holes.

Advantageously, the stationary end plate has a bypass discharge chamber defined therein and accommodating a bypass valve. The bypass discharge chamber communicates on one side thereof with the bypass holes and on the other side thereof with the discharge chamber through a bypass passage. When the fluid being compressed passes through the bypass valve, the fluid in the bypass discharge chamber causes the check valve means to open the discharge port and is discharged into the discharge chamber though the bypass passage.

According to this construction, because the discharge port is open before the compression chambers communicate with the discharge port, when a gas abnormally increased in pressure in the compression chambers in the proximity of the discharge port is discharged from the discharge port to the discharge chamber, the gas is subjected to a relatively small passage resistance, avoiding an excessive compression in the discharge port. Accordingly, the input reducing effect by the bypass action is further enhanced. Also, the period of time during which the gas is discharged from the discharge port to the discharge chamber is prolonged and, hence, the discharge speed of the compressed gas is reduced, thus reducing noise from the check valve means.

Conveniently, the bypass valve means comprises a ring-shaped bypass valve encircling the discharge port, and the stationary end plate has a bypass discharge chamber defined therein and accommodating a bypass valve. The bypass discharge chamber encircles the discharge port and communicates on one side thereof with the first bypass holes and on the other side thereof with the discharge chamber.

By this arrangement, the bypass valve can be easily provided for selectively opening and closing the bypass holes that are open to the compression chambers in the course of a final compression stroke without interfering with the check valve means which selectively opens and closes the discharge port. Moreover, because the freedom of selection of the bypass hole position is enhanced, the range in which the excessive compression is reduced can be expanded. As a result, when an excessive compression begins to occur in the compression chambers, the compressed gas is continuously and quickly discharged to the discharge chamber before the gas compression is completed. Because an extremely excessive compression can be prevented by coping with changes in a wide range of the compression ratio, the input power can be reduced and the durability can be enhanced.

In addition, because a recess defined in the stationary end plate is used as the bypass discharge chamber, the length of the bypass holes can be shortened and, hence, the period of time during which the excessively compressed gas is discharged to the discharge chamber is shortened. Accordingly, not only can the occurrence of the excessive compression be further reduced, but also input losses which may be caused by reexpansion and recompression of the compressed gas remaining in the bypass holes can be reduced.

It is preferred that the bypass valve opens or closes the first bypass holes simultaneously.

By so doing, the pressures inside the symmetrically formed compression chambers are caused to approach the pressure inside the compression chamber to thereby balance the pressures of the compression chambers. Accordingly, changes in rotational force acting on a rotation prevention member are reduced, making it possible to reduce torque changes in compression load and vibration of the compressor.

Advantageously, a spring means is provided for biasing the bypass valve so as to close the first bypass holes. The spring means has shape memory properties with which the spring means increases a biasing force thereof with an increase of a temperature thereof, while the spring means reduces the biasing force thereof with a reduction of the temperature thereof.

By this construction, under the high-load compression condition in which a pressure difference between the suction pressure and the discharge pressure is large, i.e., during high-speed compressor operations in which the temperature of the discharged gas is high and the compression ratio under an actual load condition is greater than the preset compression ratio, requiring no communication between the bypass holes and the bypass discharge chamber, the biasing force of the spring means against the bypass valve is increased to thereby enhance the reliability in closing the bypass holes.

On the other hand, under the low-load compression condition in which a pressure difference between the suction pressure and the discharge pressure is small, i.e., during low-speed compressor operations in which the temperature of the discharged gas is low and the compression ratio under an actual load condition is smaller than the preset compression ratio, requiring communication between the bypass holes and the bypass discharge chamber to avoid an excessive compression in the compression chambers, the biasing force of the spring means against the bypass valve is reduced to thereby easily open the bypass holes, resulting in an increase in the input reducing effect.

When all of the plurality of compression chambers communicate intermittently with either the discharge port or the suction chamber, it is preferred that the first bypass holes are not closed by the orbiting scroll wrap immediately before the compression chambers closest to the discharge port communicate with the discharge port and when the orbiting scroll has advanced 150° therefrom.

According to this construction, when the compression ratio during compressor operations is greater than the preset one, part of the gas contained in the compression chambers is discharged to the discharge chamber before the compression chambers communicate with the discharge port. As a result, compression inputs can be reduced by restraining an excessive compression when the gas is discharged from the discharge port.

In contrast, when the compression ratio during compressor operations is smaller than the preset one, part of the gas being compressed is discharged to the discharge chamber. Accordingly, an excessive compression is prevented to thereby reduce the compression inputs and avoid damage to the compressor.

The stationary end plate may have at least two second bypass holes defined therein at locations symmetrical in terms of pressure and each of the second bypass holes is positioned close to one of the first bypass holes. In this case, the bypass valve means comprises a single bypass valve for simultaneously opening or closing at least one of the first bypass holes and a neighboring one of the second bypass holes.

This construction continuously discharges the gas being compressed to the discharge chamber and reduces noise during discharge. Also, gas passages in the bypass holes are ensured to thereby further enhance the bypass effect.

Conveniently, the check valve means serves as the bypass valve means. This construction expands the freedom of the position of the bypass holes and achieves the bypass action in a wide range of the operating compression ratio.

Also conveniently, the check valve means and the bypass valve means is of one-piece construction to thereby reduce the manufacturing cost thereof.

The scroll compressor may further comprise an auxiliary bypass valve means for selectively opening and closing at least two auxiliary bypass holes defined in the stationary end plate. Each of the auxiliary bypass holes is positioned between a location where a corresponding one of the first bypass holes closest to the discharge port is positioned and another location spaced circumferentially outwardly less than 360° therefrom, and within a range of less than 360° from a start of compression.

This construction reduces the range in which the compression spaces become nearly closed by the bypass holes whose passages are narrowed by the orbiting scroll wrap. As a result, the frequency of occurrence of an excessive compression is reduced and, hence, inputs required for starting the compressor is reduced, thus making it possible to enhance the durability of the compressor and reduce the size of the compressor.

The stationary end plate may have injection holes defined therein and communicating with a pressure reducing device that reduces the pressure of a liquid refrigerant or a condensate in a refrigerating cycle. Each of the injection holes is circumferentially positioned between the corresponding one of the first bypass holes and a corresponding one of the auxiliary bypass holes so that the injection holes can be entirely opened and closed by the orbiting scroll wrap.

By this construction, when the compression ratio during compressor operations is greater than the preset compression ratio (insufficient compression condition), part of a vapor-liquid mixed refrigerant drawn into the compression chambers during compression cools the compression portion and increases the pressure after the compression, thereby eliminating the insufficient compression condition. As a result, when the refrigerating cycle is used in an air conditioner for room warming, an increase in discharge pressure also increases the temperature of air blown into the room, thus enhancing the warming capacity.

Even if the refrigerant is somewhat excessively introduced into the compression chambers through the injection holes during compression, the bypass action to the discharge chamber by the bypass valve means gives rise to no excessive compression. For this reason, it is not necessary to make any fine refrigerant injection adjustments to effectively utilize the refrigerant injection effect in a wide range of the operating compression ratio.

Advantageously, a refrigerant injection pipe is provided which communicates the injection holes with the pressure reducing device, with a valve mounted on the refrigerant injection pipe, wherein the valve is opened when a compression ratio during operation of the compressor is greater than a predetermined compression ratio, while the valve is closed when the compression ratio during operation of the compressor is smaller than the predetermined compression ratio.

This construction avoids compression of the refrigerant liquid immediately after the start of the compressor to thereby enhance the durability of the compressor and lighten the starting load.

Also advantageously, the scroll compressor further comprises an oil sump defined in the closed vessel and subjected to a discharge pressure, and an oil passage means communicating the oil sump with at least one of the compression chambers and the suction chamber, wherein the stationary end plate has a bypass discharge chamber defined therein at a location between the compression chambers and the check valve means and accommodating a bypass valve. The bypass discharge chamber communicates on one side thereof with the bypass holes and on the other side thereof with the discharge chamber. The bypass valve allows the fluid to flow only from the compression chambers towards the bypass discharge chamber. When the bypass valve is opened, a valve body of the check valve means is pushed up thereby to open the discharge port.

By this arrangement, when the pressure inside the compression chambers has become greater than the pressure inside the discharge chamber, the bypass valve opens and part of a gas being compressed is discharged to the discharge chamber through the bypass discharge chamber, thus restraining an increase in pressure in the compression chambers and avoiding an increase in compression inputs.

Furthermore, before the compression chambers open to the discharge chamber, the bypass valve causes the check valve means to open the discharge port. Accordingly, part of the gas which has caused an abnormal increase in pressure in the compression chambers closest to the discharge port is discharged to the discharge chamber through the bypass holes and the discharge port. Also, immediately after the compression chambers and the discharge port have communicated with each other, the compressed gas is discharged to the discharge chamber under the condition in which gas passage resistance is relatively small and, hence, the frequency of occurrence of an excessive compression in the compression chambers or the discharge port is reduced, resulting in a reduction in compression inputs.

Conveniently, the bypass valve is provided with a reed valve body having a head portion encircling the discharge port so as to simultaneously open or close the first bypass holes.

This construction makes the bypass valve compact and reduces the manufacturing cost thereof. Also, appropriate bypass passages are ensured by arranging a plurality of bypass holes in the proximity of the discharge port, thus achieving an effective bypass action and contributing to a reduction in compression inputs. Because a continuous bypass action reduces the frequency of opening and closing of the bypass valve, noise or vibration of the compressor is reduce.

Advantageously, the bypass valve means and the check valve means are of one-piece construction and comprise respective reed valve bodies close to each other. The reed valve body of the bypass valve means has a spring constant smaller than that of the reed valve body of the check valve means.

This construction not only shortens the period of time required for mounting the check valve means and the bypass valve means, but also enhances the positional accuracy thereof. Accordingly, the bypass valve means integrally formed with the durable check valve means and having a relatively small spring constant can be readily accurately mounted on the orbiting end plate without any deviation thereof from the bypass holes, thus preventing a back-flow from the discharge chamber to the compression chambers through the bypass holes and eliminating harmful effects which may be caused by the provision of the bypass valve means. Also, the manufacturing and assembling costs of parts are reduced.

It is preferred that the reed valve body of the bypass valve means and the reed valve body of the check valve means extend substantially in the same direction.

This construction facilitates handling of the parts, enhances the assembling accuracy thereof relative to the bypass holes and the discharge port, and shortens the period of time required for mounting them. Furthermore, because the direction of the metallic texture or organization inherent in material of the reed valve bodies can be aligned with the longitudinal direction of the reed valve bodies, the rigidity of the reed valve bodies is increased to thereby enhance the reliability of the compressor.

It is also preferred that a valve seat for the check valve means is higher than a valve seat for the bypass valve means.

According to this arrangement, because the bypass valve means is not opened, even slightly, by the diffusion of an air current when the compressed gas is discharged from the discharge port to the discharge chamber, the closure of the bypass holes is continued. Also, because the check valve means begins to open slightly under the influence of the gas pressure when the bypass valve means opens the bypass holes to introduce the gas in the compression chambers into the discharge chamber therethrough, the compressed gas is smoothly discharged to the discharge chamber through the discharge port after the compression chambers have communicated with the discharge port at a final stage, thus reducing an excessive compression in the discharge port.

Conveniently, the bypass valve means comprises a plurality of bypass valves integrally connected together and disposed on respective sides of the valve seat for the check valve means at locations close thereto.

Because this construction can accurately position the bypass valves by making use of side walls of the valve seat for the check valve means, an undesirable positional deviation of the bypass valves from the associated bypass holes can be eliminated without accompanying harmful effects which may be caused by the provision of the bypass valves.

The stationary end plate may have at least two second bypass holes defined therein. In this case, it is preferred that the bypass valve means comprises two valve bodies having different spring constants so that those bypass holes of the first and second bypass holes that are open to the same compression chamber are opened or closed simultaneously by a corresponding one of the two valve bodies.

By this construction, even if those points of the bypass valves differ on which the gas pressures act when the gas being compressed is discharged to the discharge chamber through the bypass holes, all of the bypass valves can be entirely opened substantially simultaneously by appropriately selecting the spring constants of the bypass valves.

Furthermore, it is possible to avoid adverse effects which are likely caused by the extension of the bypass valves in the same direction and by the integral connection thereof (an increase in compression torque variations caused by a difference in pressure distribution of the symmetrical compression spaces).

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Figure 1:
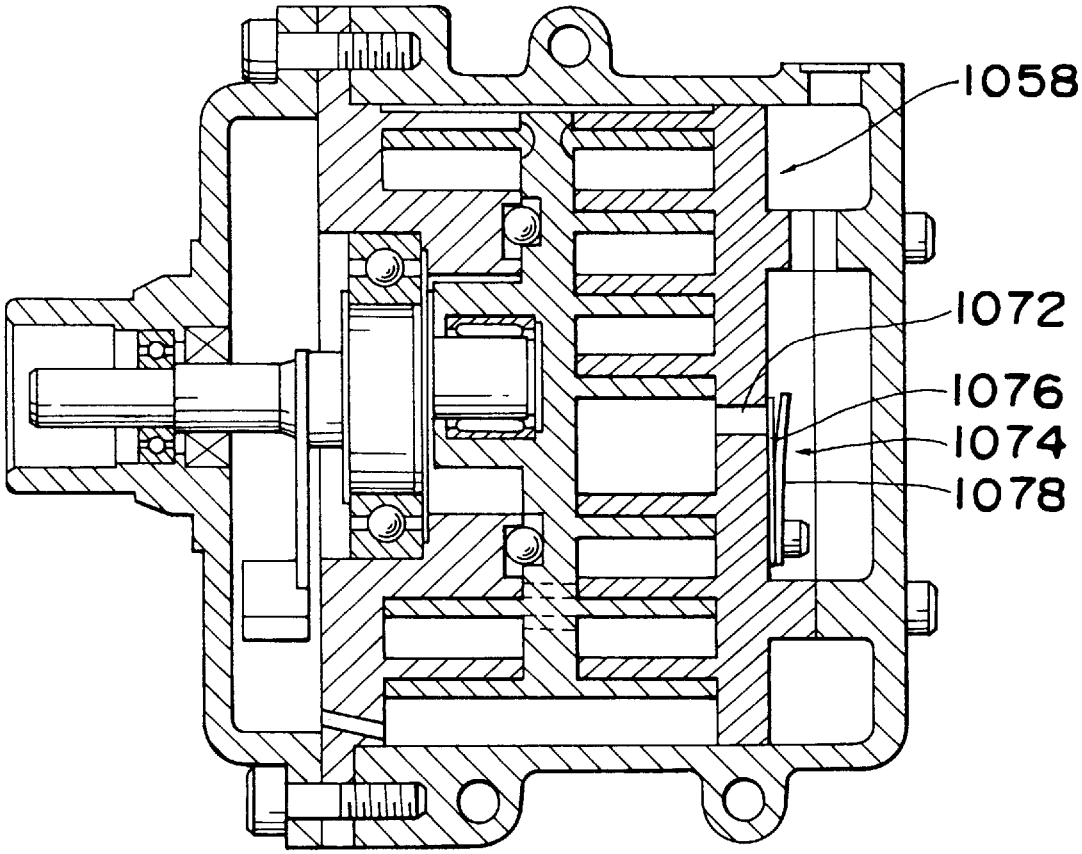
Fig. 1 PRIOR ART
FIG. 1 is a vertical sectional view of a conventional scroll air compressor.
Figure 2:
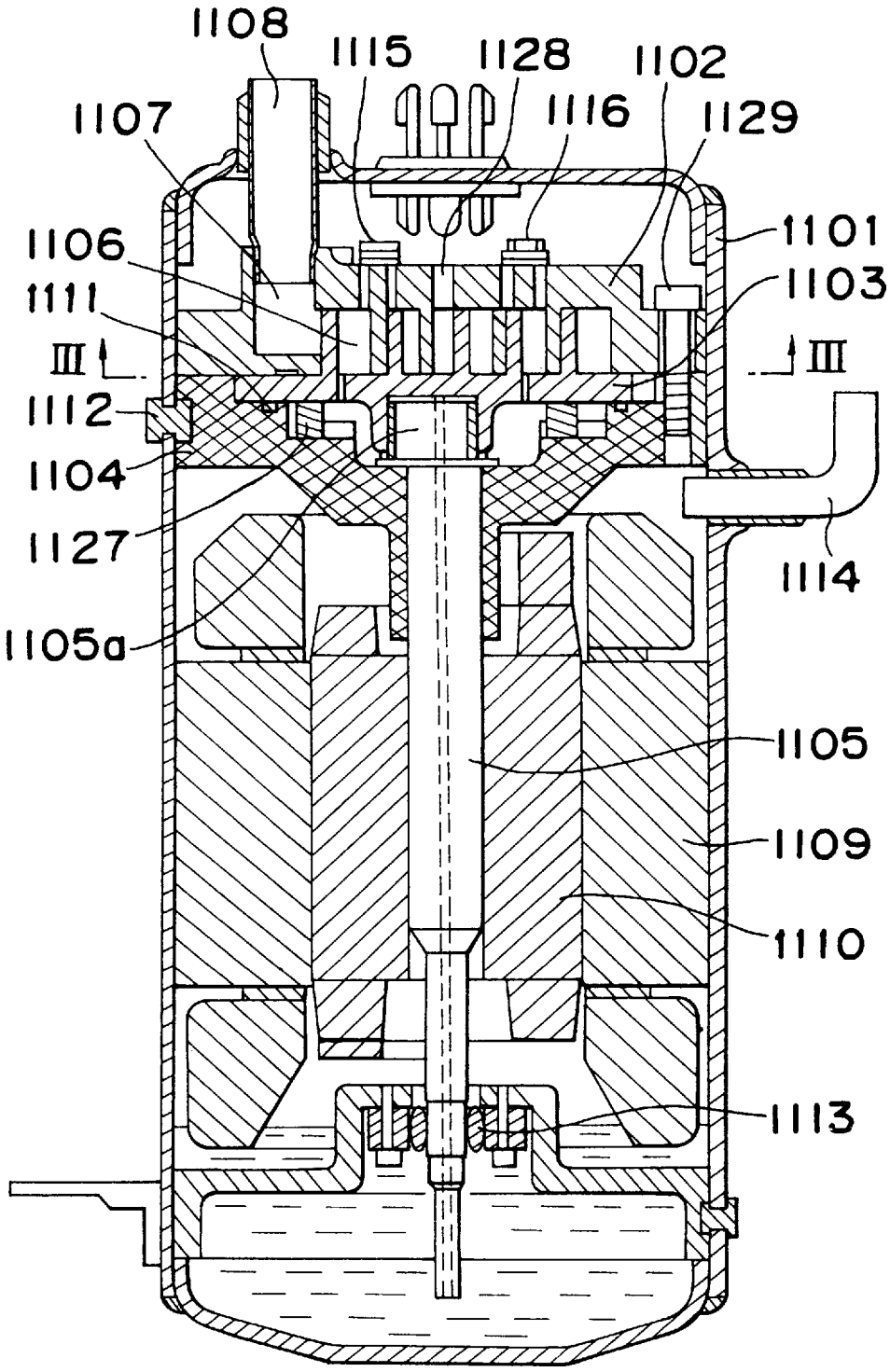
Fig. 2 PRIOR ART
FIG. 2 is a vertical sectional view of another conventional scroll air compressor.
Figure 3:
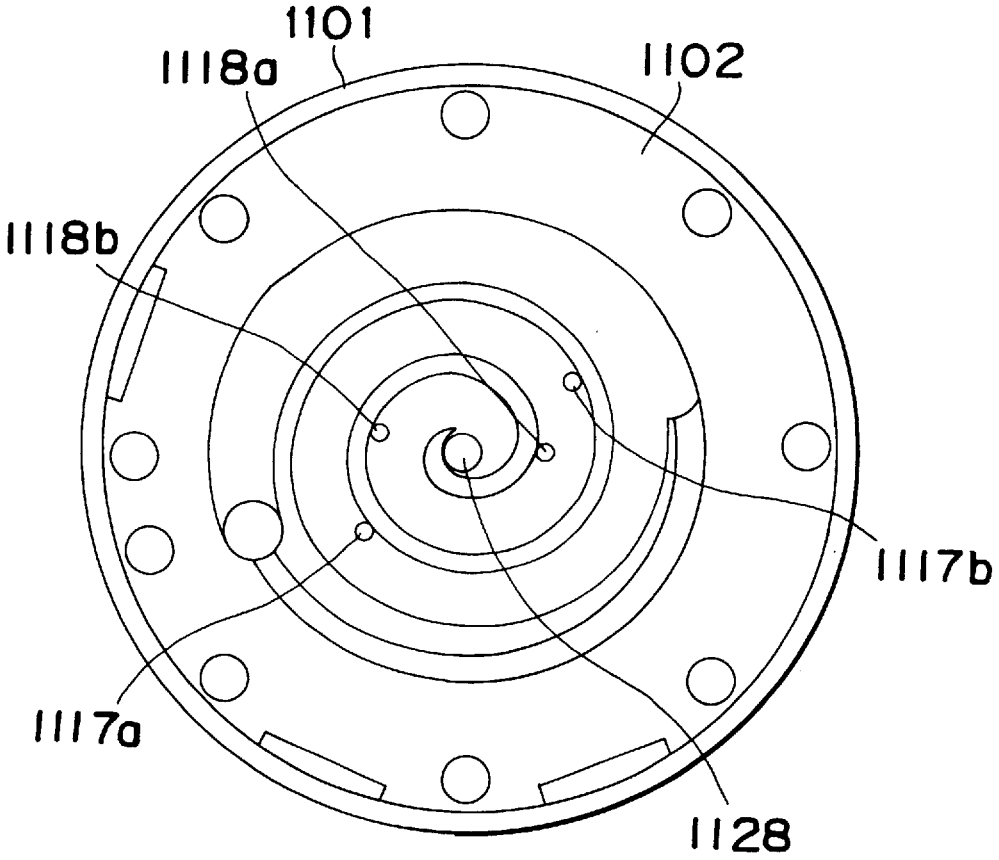
Fig. 3 PRIOR ART
FIG. 3 is a sectional view taken along line III—III in FIG. 2.
Figure 4A:
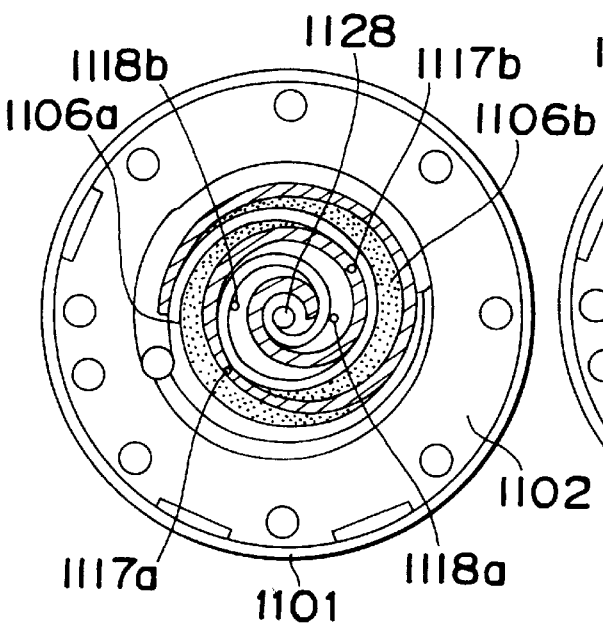
Fig.4A PRIOR ART
FIGS. 4A, 4B, 4C and 4D are sectional views similar to FIG. 3, but particularly depicting changes in cross section of compression chambers during compression and a positional relationship of bypass holes.
Figure 4B:
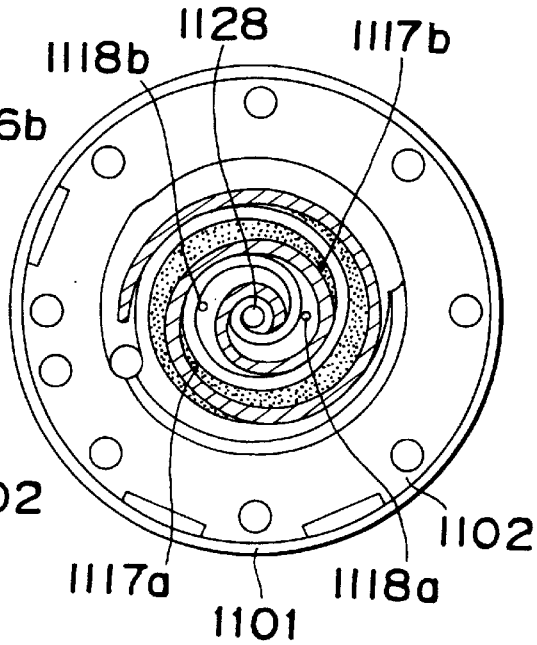
Fig.4B PRIOR ART
Figure 4D:
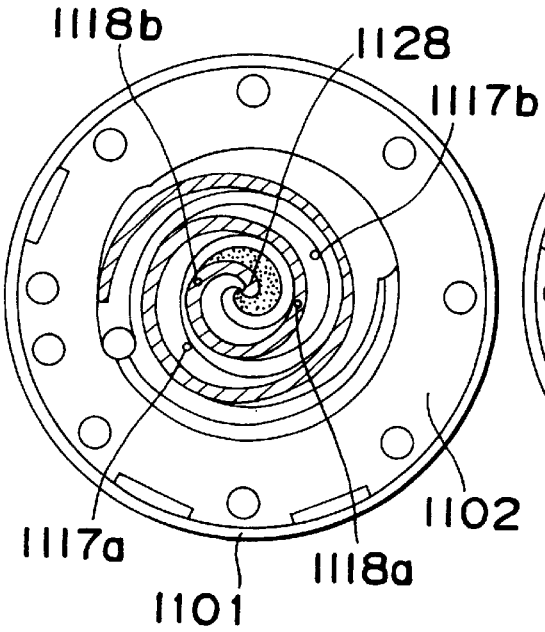
Fig.4D PRIOR ART
Figure 4C:
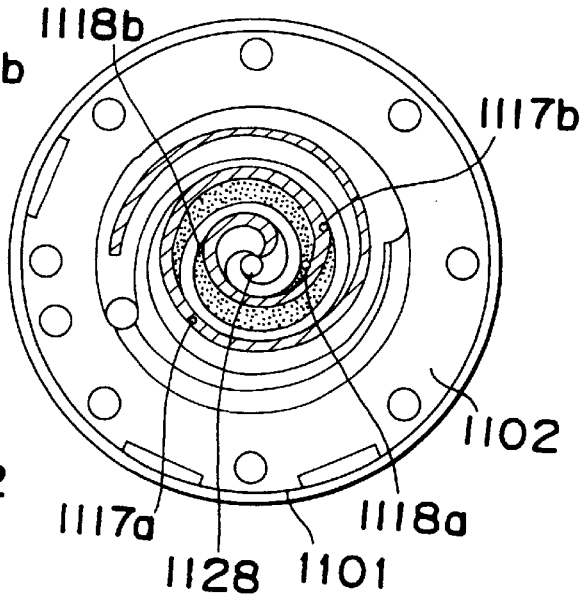
Fig.4C PRIOR ART

Referring now to the drawings, there is shown in FIGS. 5 to 13 a horizontally arranged scroll refrigerant compressor according to a first embodiment of the present invention. This scroll compressor has an iron-made closed vessel 1 accommodating a high-pressure atmosphere in the entire inside thereof that communicates with a discharge pipe (not shown). The closed vessel 1 accommodates an electric motor 3 disposed at a central portion thereof and a compression portion disposed on the right-hand side thereof, as viewed in FIG. 5. The electric motor 3 has a rotor 3*a* fixedly mounted on a drive shaft 4, one end of which is rotatably supported by a main frame 5 of the compression portion. The main frame 5 is secured to the inner surface of the closed vessel 1.

The compression portion includes a stationary scroll 7 and an orbiting scroll 13 both engaging with each other to define a plurality of volume-variable working pockets 2 therebetween. The stationary scroll 7 has a stationary end plate 7*a* and a stationary scroll wrap 7*b* integrally formed with and protruding axially from the stationary end plate 7*a*, while the orbiting scroll 13 has an orbiting end plate 13*b*, an orbiting scroll wrap 13*a* integrally formed with and protruding axially from the orbiting end plate 13*b*, and an eccentric shaft 13*c* integrally formed with the orbiting end plate 13*b* so as to extend therefrom in a direction opposite to the direction in which the orbiting scroll wrap 13*a* extends. The orbiting end plate 13*b* is disposed between the stationary scroll 7 and the main frame 5, and is axially supported by a thrust bearing 19 integrally formed with the main frame 5 with a slight space defined between the orbiting end plate 13*b* and the thrust bearing 19 to form an oil film therein. The stationary scroll 7 has a discharge port 30 defined therein at a central portion of the stationary scroll wrap 7*b*, while a suction chamber 31 is defined at an outer peripheral portion of the stationary scroll wrap 7*b*. The discharge port 30 communicates with the high-pressure space around the electric motor 3 via a discharge chamber 32 adjoining the discharge port 30. The suction chamber 31 communicates with a suction pipe 33 extending through an end wall of the closed vessel 1.

Figure 6:
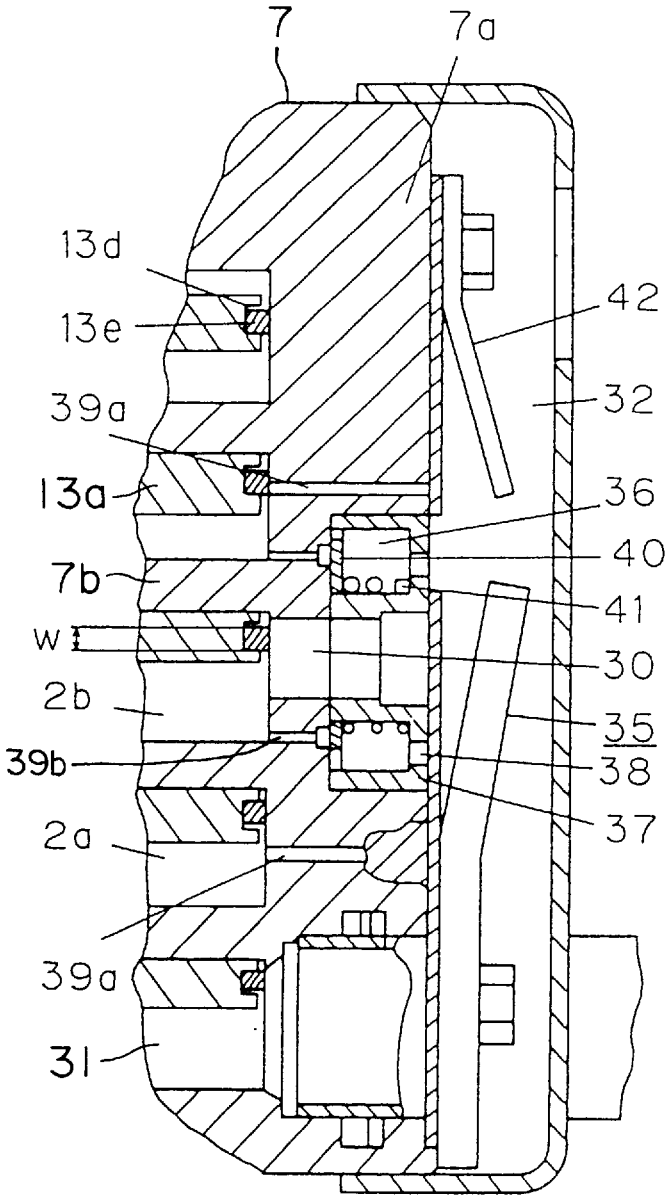
FIG. 6 is a fragmentary vertical sectional view of an essential portion of the scroll refrigerant compressor of FIG. 5 under the condition in which bypass holes are closed.

As shown in FIG. 6 and as is the case with a compressor as disclosed in Japanese Utility Laid-open Publication (unexamined) No. 62-26591, the orbiting scroll wrap 13*a* has a scroll-shaped groove 13*d* defined in a free end thereof. A sealing member 13*e* is radially loosely received in the scroll-shaped groove 13*d* so that oil films may be formed around the sealing member 13*e*.

The drive shaft 4 has an oil hole 12 defined therein so as to extend axially thereof, and the oil hole 12 communicates on one side thereof with an oil supply pump (not shown) and on the other side thereof with a main bearing 8.

The eccentric shaft 13*c* of the orbiting scroll 13 is journaled in an eccentric bearing 14, which is in turn accommodated within a recess defined in an end portion of the drive shaft 4. The orbiting end plate 13*b* has an annular recess defined therein around the eccentric shaft 13*c* generally in concentric relation therewith, while an annular sealing member 18 is loosely received in the annular recess. The annular sealing member 18 partitions a space defined between the orbiting end plate 13*b* and the main frame 5 into a first back chamber 20 positioned radially inwardly thereof and a space positioned radially outwardly thereof. The first back chamber 20 communicates with an oil sump 11 accommodating lubricating oil, on which the discharge pressure acts, via the sliding surface of the eccentric bearing 14, the oil hole 12 of the drive shaft 4, and the main bearing 8.

The orbiting end plate 13*b* has an oil passage 21 defined therein through which an oil chamber 15 defined on the bottom of the eccentric bearing 14 communicates with a third back chamber 16 defined outside of the orbiting end plate 13*b*. The oil passage 21 has a first throttled portion 22 and a second throttled portion 23 on opposite ends thereof, and also has a bypass oil hole 24 branched from an intermediate portion thereof. The bypass oil hole 24 intermittently communicates with an annular oil groove 25 defined in the bearing surface of the thrust bearing 19 as the orbiting scroll 13 undergoes an orbiting motion. The annular oil groove 25 communicates with the third back chamber 16 via a radial oil discharge passage 26 constituting part of the annular oil groove 25, and also communicates intermittently with grooves (not shown) of the orbiting scroll 13, in which a rotation prevention member 27 is engaged. The third back chamber 16 communicates with the suction chamber 31 via an oil groove 43 defined in the surface of the stationary end plate 7*a* which is in sliding contact with the orbiting end plate 13*b* (see FIG. 8).

It is to be noted that the orbiting end plate 13*b* may have oil holes defined therein generally axially thereof to introduce the lubricating oil into the compression chambers 2.

A check valve assembly 35 comprising a reed valve 35*a* made of a thin steel plate and a valve retainer 35*b* for selectively opening and closing the discharge port 30 is mounted on the flat surface of the stationary end plate 7*a*. A check valve seat casing 37 is pressed into a recess defined in the stationary end plate 7*a* and has a flat top surface on the same level as the flat surface of the stationary end plate 7*a*. An annular bypass discharge chamber 36 is defined in the check valve seat casing 37 so as to encircle the discharge port 30 and is positioned close to the check valve assembly 35 (see FIGS. 6 and 7). The bypass discharge chamber 36 communicates with the discharge chamber 32 via bypass passages 38 defined in a top wall of the check valve seat casing 37.

Figure 7:
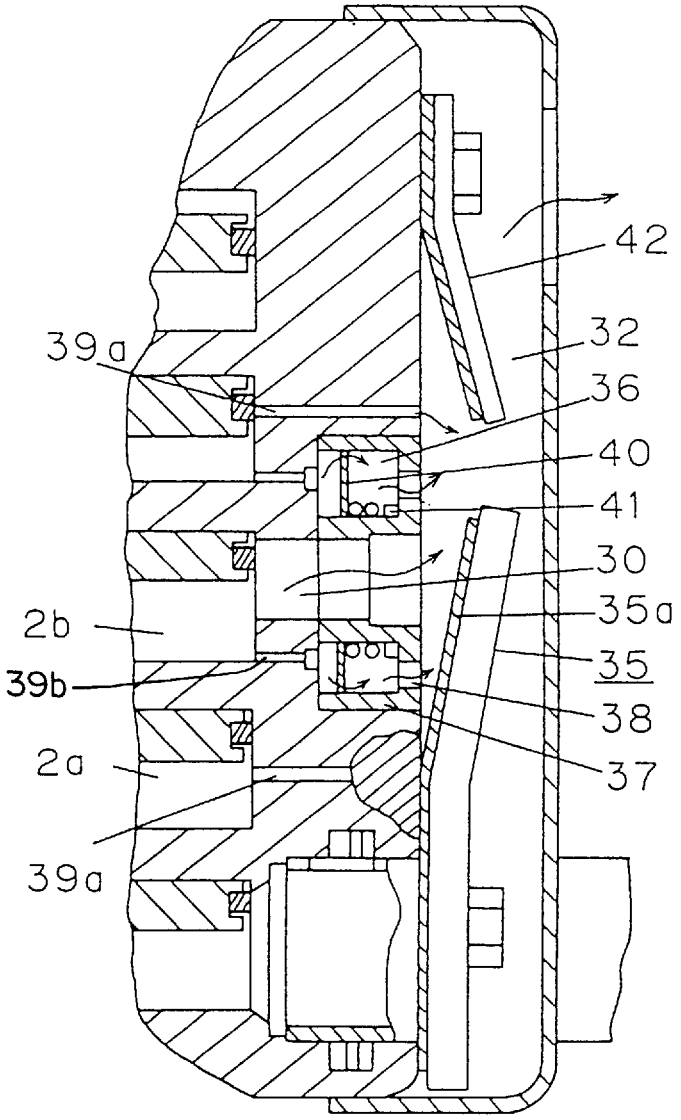
FIG. 7 is a view similar to FIG. 6, but depicting the condition in which the bypass holes are opened.
Figure 8:
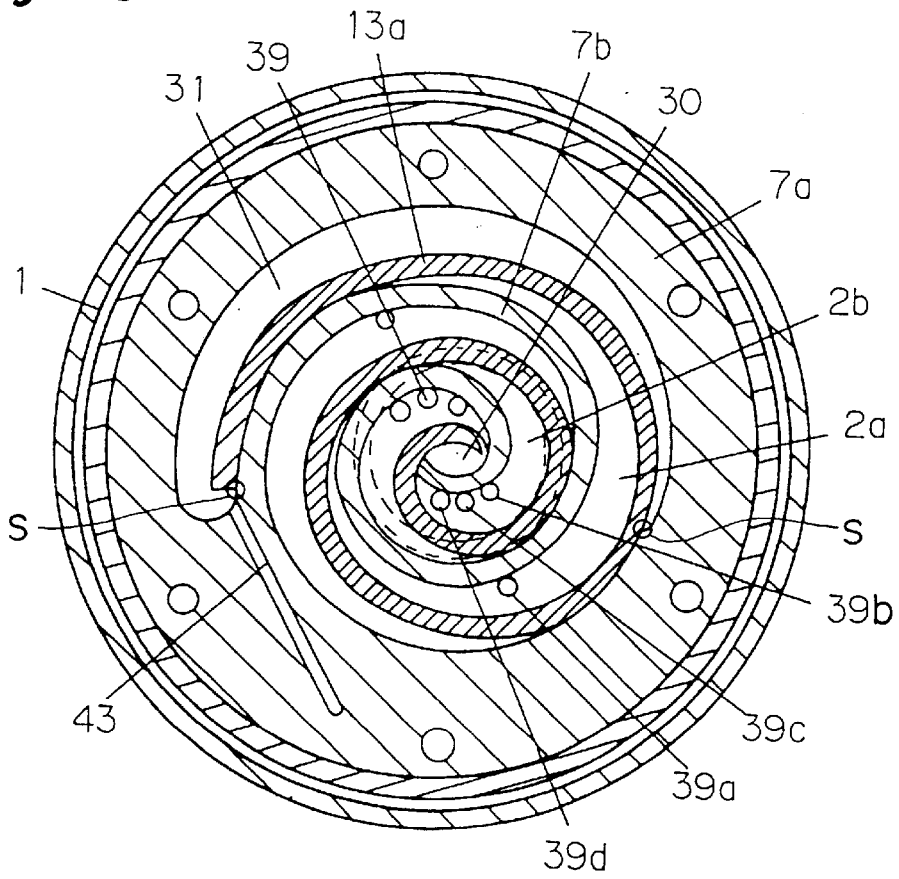
FIG. 8 is a sectional view taken along line VIII—VIII in FIG. 5.

As shown in FIGS. 6 to 8, the stationary end plate 7*a* has a plurality of bypass holes 39 defined therein generally at a central portion thereof. The bypass holes 39 are open to second compression chambers 2*b* communicating intermittently with the discharge port 30 and also to the bypass discharge chamber 36. Each of the bypass holes 39 has, at its end open to the second compression chamber 2*b*, a diameter smaller than the width W of the sealing member 13*e* mounted on the free end of the orbiting scroll wrap 13*a*.

The bypass holes 39 include two second bypass holes 39*b*, two third bypass holes 39*c*, and two fourth bypass holes 39*d*. The bypass holes 39 on one side of the discharge port 30 are positioned symmetrically in terms of pressure with those on the other side of the discharge port 30. That is, the bypass holes 39 of the former are subjected to substantially the same pressure as the corresponding bypass holes 39 of the latter. The bypass holes 39 are formed along the wall surfaces of the stationary scroll wrap 7*b* so as to follow the progress of compression. Further, on each side of the discharge port 30, the second bypass hole 39*b*, third bypass hole 39*c*, and fourth bypass hole 39*d* are appropriately spaced from one another so that all of them may not be closed simultaneously by the sealing member 13*e*.

The bypass discharge chamber 36 accommodates a bypass valve assembly 40 for selectively opening and closing the second to fourth bypass holes 39*b*–39*d* and a coil spring 41 for biasing the bypass valve assembly 40.

Figure 5:
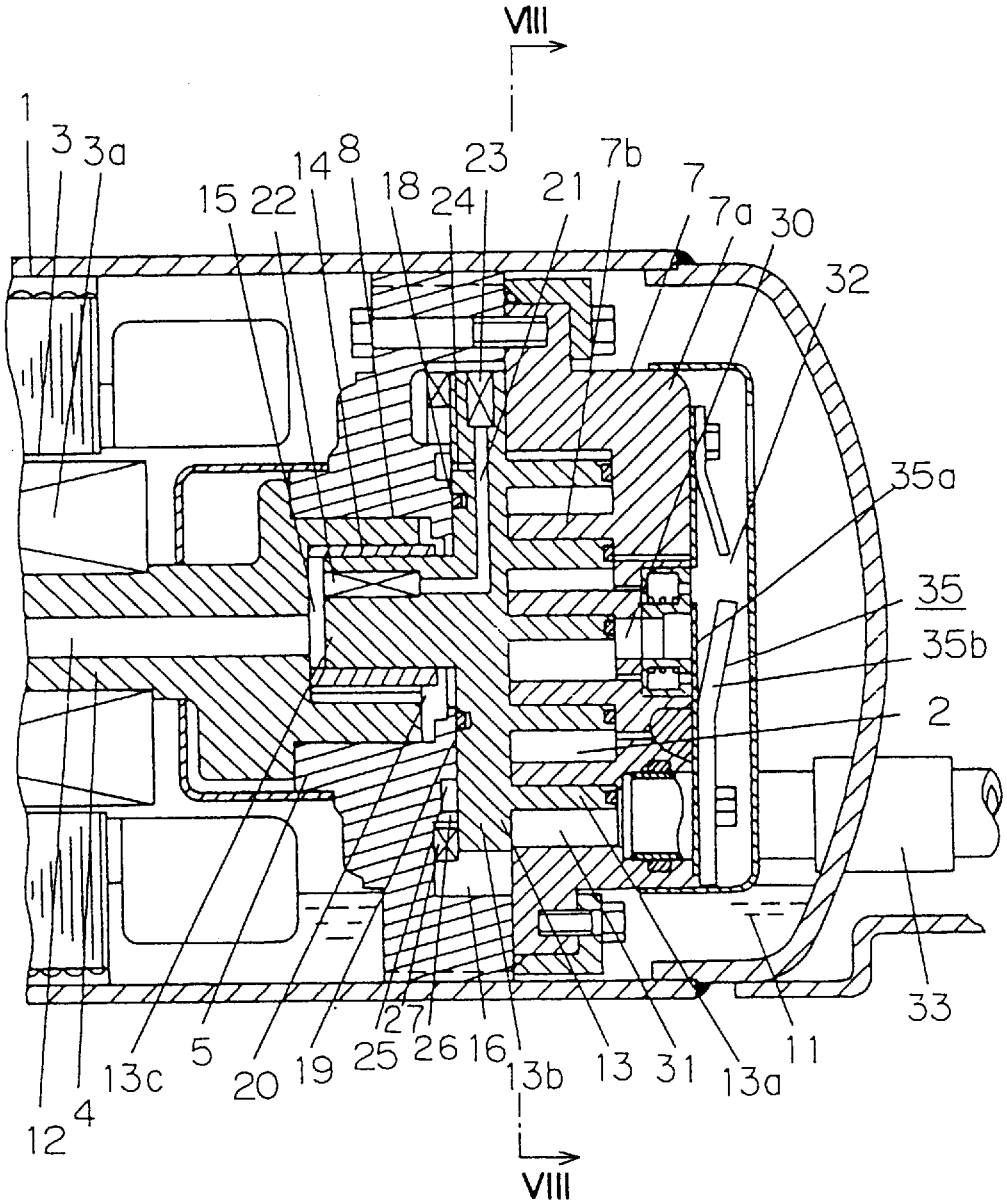
FIG. 5 is a fragmentary vertical sectional view of a scroll refrigerant compressor according to a first embodiment of the present invention.

FIG. 8 is a sectional view taken along line VIII—VIII in FIG. 5 and depicts the condition of the working pockets (compression chambers) immediately after the second compression chamber 2*b* communicating intermittently with the discharge port 30 has just communicated therewith. The volume ratio of the working pockets 2 (the ratio of the suction volume of the working pockets 2 to the volume of the working pockets 2 at the completion of compression) is determined so as to become substantially equal to the volume ratio corresponding to the ratio (operating compression ratio) of the pressure of the suction chamber 31 to the pressure of the discharge chamber 32 at the rated load of the compressor. For this reason, the stationary and orbiting scroll wraps 7*b* and 13*a* are in the form of a scroll suited to minimize excessively insufficient compression in the working pockets 2 at the rated load operation.

At the moment shown in FIG. 8, the second to fourth bypass holes 39*b*–39*d* are not closed by the orbiting scroll wrap 13*a*. Also, even when the second compression chambers 2*b* are positioned at locations spaced a distance from the condition shown in FIG. 8 in a clockwise or counterclockwise direction, the second to fourth bypass holes 39*b*–39*d* are not closed simultaneously by the orbiting scroll wrap 13*a* according to the shape thereof and intervals therebetween.

Figure 9:
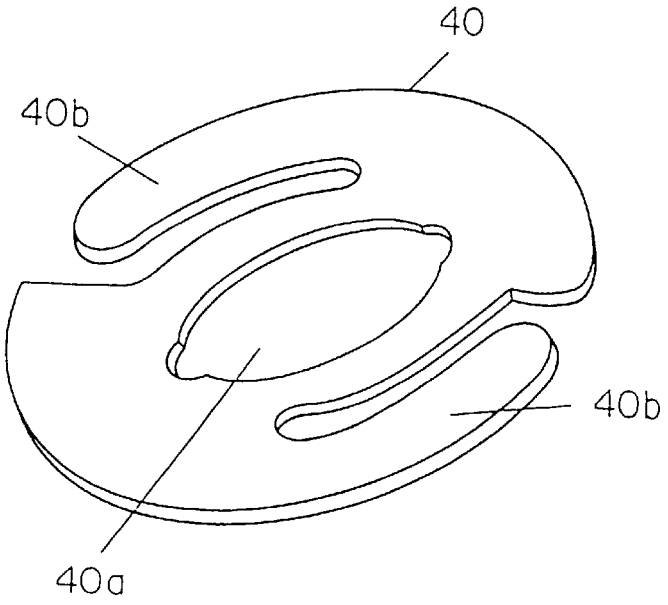
FIG. 9 is a perspective view of a bypass valve mounted in the scroll refrigerant compressor of FIG. 5.

As shown in FIG. 9, the bypass valve assembly 40 is ring-shaped and has a center hole 40*a* in which the check valve seat casing 37 is engaged to prevent rotation of the bypass valve assembly 40. The bypass valve assembly 40 also has a pair of reed portions 40*b* formed on respective sides of the center hole 40*a* for selectively opening and closing the second to fourth bypass holes 39*b*–39*d*.

The coil spring 41 has shape memory properties with which it increases its biasing force applied to the bypass valve assembly 40 with an increase of its own temperatures, while it reduces its biasing force to the bypass valve assembly 40 with a reduction of its own temperatures.

The stationary end plate 7*a* also has two first bypass holes 39*a* formed symmetrically on respective sides of the discharge port 30. The first bypass holes 39*a* are open to the first compression chambers 2*a* communicating intermittently with the suction chamber 31 and also to the discharge chamber 32. As shown in FIGS. 6 and 7, the first bypass holes 39*a* are selectively opened and closed by the corresponding auxiliary bypass valve assemblies 42 mounted on the stationary end plate 7*a*. Each of the first bypass holes 39*a* is circumferentially positioned between the outer end S of the outer or inner wall surface of the stationary scroll wrap 7*b* and a location spaced 360° therefrom in the clockwise direction (towards the inner end of the stationary scroll wrap 7*b*) along the stationary scroll wrap 7*b*. Also, each of the first bypass holes 39*a* is circumferentially positioned between the corresponding bypass hole group 39*b*–39*d* and a location spaced 360° therefrom in the counterclockwise direction (towards the outer end S) along the stationary scroll wrap 7*b*.

It is, however, to be noted that all of the bypass holes 39*a*–39*d* are circumferentially positioned between the discharge port 30 and a location or locations where the lubricating oil is introduced into the suction chamber 31 or the compression chambers 2. In other words, all of the bypass holes 39*a*–39*d* are circumferentially closer than such location or locations relative to the discharge port 30.

Figure 10:
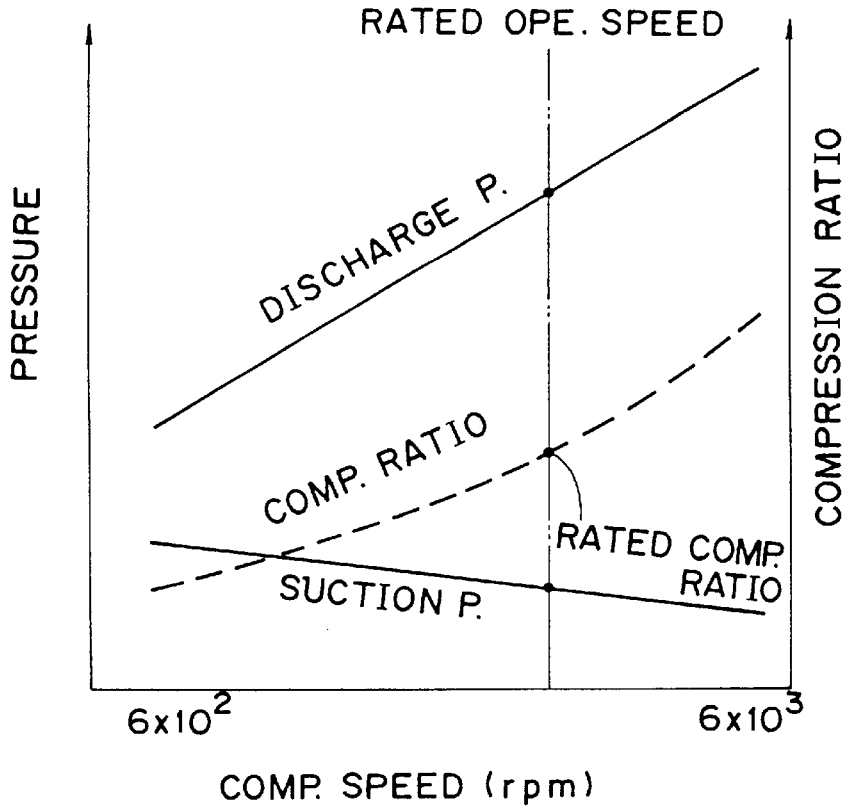
FIG. 10 is a graph indicating relationships between the compressor operating speed and the pressure and between the former and the compression ratio.

FIG. 10 is a graph indicating a relationship between the compressor speed and the suction and discharge pressures and between the former and the compression ratio during the operation of the air conditioner.

Figure 11:
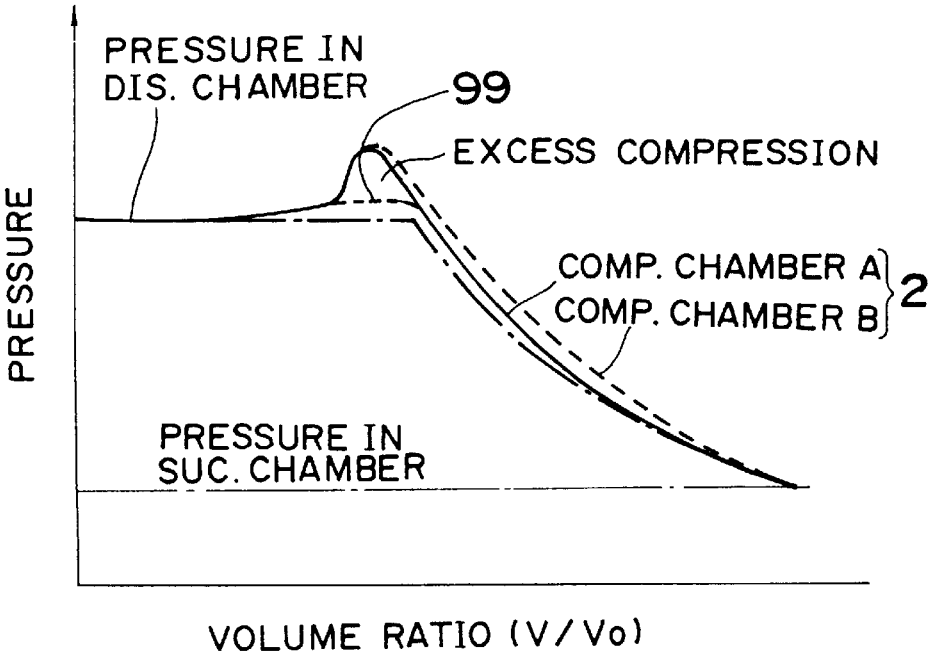
FIG. 11 is a graph indicating a relationship between volume changes and pressure changes in the compression chambers.

FIG. 11 is a P-V diagram of a conventional scroll air compressor indicating a relationship between volume changes of the compression chambers and pressure changes of the compression chambers.

In FIGS. 5 to 11, rotation of the drive shaft 4 by the electric motor 3 causes the orbiting scroll 13 supported by the thrust bearing 19 of the main frame 5 to undergo an orbiting motion. At this moment, the suction refrigerant gas containing lubricating oil is introduced from a refrigerating cycle connected to the compressor into the suction chamber 31 via the suction pipe 33. The suction refrigerant gas is then led into and compressed in the compression chambers 2 formed between the orbiting scroll 13 and the stationary scroll 7. The refrigerant gas thus compressed passes through the discharge port 30 formed at the center of the compression chambers 2 and through the discharge chamber 32 and cools the electric motor 3 before it is discharged from a discharge pipe (not shown) to the outside of the compressor.

The discharged refrigerant gas containing the lubricating oil is separated from the lubricating oil on the way to the discharge pipe from the discharge chamber 32. The lubricating oil separated from the refrigerant gas is collected in the oil sump 11, on which the discharge pressure acts. The lubricating oil in the oil sump 11 is then supplied to the oil hole 12 of the drive shaft 4 by an oil supply pump (not shown) connected to one end of the drive shaft 4 and is further supplied to the oil chamber 15. Most of the lubricating oil in the oil chamber 15 is returned to the oil sump 11 via the main bearing 8, while the remaining lubricating oil is introduced into the third back chamber 16 via the oil passage 21 provided in the orbiting scroll 13.

The lubricating oil flowing through the oil passage 21 is first reduced in pressure at the first throttled portion 22 formed on the inlet side thereof. Part of the lubricating oil thus reduced in pressure passes through the bypass oil hole 24 and is then introduced into the annular oil groove 25 provided in the thrust bearing 19. The remaining lubricating oil is further reduced in pressure at the second throttled portion 23. Having passed through the different passages, the lubricating oils join in the third back chamber 16 leading to the suction chamber 31.

The lubricating oil in the oil passage 21 is affected by a passage resistance when the bypass oil hole 24 communicates intermittently with the annular oil groove 25 during the orbiting motion of the orbiting scroll 13. More specifically, when the orbiting speed of the orbiting scroll 13 is low, the lubricating oil in the oil passage 21 flows into the annular oil groove 25 in large quantities. In contrast, when the orbiting speed of the orbiting scroll 13 is high, the lubricating oil in the oil passage 21 flows into the annular oil groove 25 in small quantities.

The pressure of the refrigerant gas in the compression chambers 2 acts to move the orbiting scroll 13 away from the stationary scroll 7 in a direction longitudinally of the drive shaft 4. On the other hand, the orbiting end plate 13*b* of the orbiting scroll 13 receives a back pressure from the first back chamber 20 (an inner portion encircled by the annular sealing member 18) on which the discharge pressure acts. Accordingly, the force (this force is hereinafter referred to as the separation force) acting to move the orbiting scroll 13 away from the stationary scroll 7 and the back pressure cancel. When the back pressure is greater than the separation force, the orbiting end plate 13*b* is supported by the stationary end plate 7*a* of the stationary scroll 7. In contrast, when the back pressure is smaller than the separation force, the orbiting end plate 13*b* is supported by the thrust bearing 19.

In each of the above cases, very small gaps are maintained between the orbiting end plate 13*b* and the surfaces with which the orbiting end plate 13*b* is in sliding contact, and oil films are formed in these gaps by the lubricating oil supplied thereto, thereby reducing the sliding resistance. Even in each of the cases in which the orbiting end plate 13*b* of the orbiting scroll 13 is supported by the stationary end plate 7*a* of the stationary scroll 7 or the thrust bearing 19, an axial gap of the compression chambers 2 is very small and is hermetically sealed by an oil film of the lubricating oil which has been introduced into the compression chambers 2 via the third back chamber 16 and the suction chamber 31.

On the other hand, because the scroll air compressor has a constant compression ratio depending on the volume ratio thereof and the characteristics of the refrigerant, a large quantity of the refrigerant liquid enters the compression chambers 2 at the initial stage of cold starting of the compressor. As a result, liquid compression occurs, and the pressure inside the compression chambers 2 increases abnormally and becomes greater than the pressure inside the discharge chamber 32.

As shown in FIGS. 7 to 9, in the case where the liquid compression occurs in the first compression chambers 2*a* communicating intermittently with the suction chamber 31, the auxiliary bypass valve assemblies 42 closing the first bypass holes 39*a* and the reed portions 40*b* of the bypass valve assembly 40 closing the second, third and fourth bypass holes 39*b*–39*d* are successively opened to introduce the refrigerant into the discharge chamber 32, thus reducing the pressure inside the compression chambers 2.

In the case where the liquid compression occurs in the second compression chambers 2*b* communicating intermittently with the discharge port 30, the bypass valve assembly 40 closing the second, third and fourth bypass holes 39*b*–39*d* is opened against the biasing force of the coil spring 41 to introduce the refrigerant into the discharge chamber 32, thus reducing the pressure inside the compression chambers 2.

Because the second to fourth bypass holes 39*b*–39*d* are positioned so as not to be closed simultaneously by the free end of the orbiting scroll wrap 13*a*, the bypass valve assembly 40 is opened without fail.

It is to be noted that the opening of the auxiliary bypass valve assemblies 42 and the bypass valve assembly 40 is not limited to the case in which the liquid compression occurs in the compression chambers 2.

More specifically, as shown in FIG. 10, the suction pressure in the ordinary refrigerating cycle operation reduces with an increase in compressor speed, while the discharge pressure generally increases, resulting in an increase in volume ratio. Accordingly, if the auxiliary bypass valve assemblies 42 and the bypass valve assembly 40 are not provided, the volume ratio, for example, at a low speed operation becomes smaller than the volume ratio set at the rated load operation. As shown by oblique lines in FIG. 11, the inside of the compression chambers 2 are placed in an excessively compressed condition.

In such a case, the reed portions 40*b* of the bypass valve assembly 40 closing the second to fourth bypass holes 39*b*–39*d* are opened to introduce the refrigerant into the discharge chamber 32. As a result, as shown by a double-dotted chain line 99 in FIG. 11, the pressure inside the compression chambers 2 is reduced on the way to thereby lighten the compression load.

In general, the pressures in the symmetrically formed compression chambers 2 (compression chamber A and compression chamber B) differ due to a difference in the degree of sealing the axial gap of the compression chambers 2. The pressure difference in the compression chambers 2 causes a force of rotation of the orbiting scroll 13 about its own axis and, hence, imparts a rotational force to the rotation prevention member 27.

However, when the compression load is lightened by the opening of the auxiliary bypass valve assemblies 42 and the bypass valve assembly 40, the pressures in the compression chambers 2 (chamber A and chamber B) are instantaneously made uniform through the discharge chamber 32 in the course of the compression operation, resulting in a reduction in pressure difference between the compression chambers.

When the refrigerant gas being now compressed and discharged into the bypass discharge chamber 36 is introduced into the discharge chamber 32 via the bypass passages 38, the reed valve 35*a* of the check valve assembly 35 is pushed up, to thereby communicate the discharge port 30 with the discharge chamber 32, as shown in FIG. 7. The refrigerant gas inside the second compression chambers 2*b* receives no passage resistance immediately after its introduction into the discharge port 30, because the reed valve 35*a* of the check valve assembly 35 is opened without delay. Accordingly, the refrigerant gas inside the second compression chambers 2*b* is smoothly discharged into the discharge chamber 32 and, hence, no excessive compression occurs in the discharge port 30.

On the other hand, when the compressor is operated at a high speed, the pressure in the suction chamber 31 reduces and the pressure in the discharge chamber 32 increases. As a result, the compression ratio during the actual refrigerating cycle operation becomes greater than the compression ratio set in the scroll refrigerant compressor (the bypass valve assembly 40 is not opened).

Under such a condition, when the volume of the second compression chambers 2*b* is being enlarged and before the discharge port 30 is closed by the check valve assembly 35, the refrigerant gas in the discharge chamber 32 flows intermittently back into the second compression chambers 2*b* through the discharge port 30. This back-flow refrigerant gas is compressed again in the second compression chambers 2*b*, thus causing compression loss.

However, When the lubricating oil supplied to the suction chamber 31, along with the suction refrigerant gas, passes through the compression chambers 2, the axial gap of the compression chambers 2 and the gap between the scroll-shaped groove 13*d* and the sealing member 13*e* are sealed by oil films, thus preventing the refrigerant gas from flowing back into the compression chambers that do not communicate with the discharge port 30.

Furthermore, because the bypass holes 39 (39*a*–39*d*) having a diameter smaller than the width W of the sealing member 13*e* are filled with the lubricating oil supplied to the compression chambers 2, the quantity of refrigerant gas remaining in the bypass holes 39 is reduced. Accordingly, compression loss which may be caused by reexpansion and recompression of the refrigerant gas remaining in the bypass holes 39 is very small.

Also, because an annular recess in the stationary end plate 7*a* is used as the bypass discharge chamber 36, the length of the second to fourth bypass holes 39*b*–39*d* is relatively short. For this reason, the compression loss which may be caused by reexpansion and recompression of the refrigerant gas remaining in the bypass holes 39 is reduced to the extent of being negligible.

Moreover, the discharge passage of the compressed refrigerant gas is narrow immediately after the second compression chambers 2*b* have just communicated with the discharge port 30, and the opening of the check valve assembly 35 is somewhat delayed. Accordingly, immediately after communication with the discharge port 30, the second compression chamber 2*b* tends to become higher in pressure than the discharge chamber 32.

However, because part of the compressed refrigerant gas is discharged into the bypass discharge chamber 36 through the bypass holes 39 and the bypass valve assembly 40, the pressure inside the second compression chambers 2*b* reduces, thus avoiding an excessive compression and reducing compression inputs.

Thereafter, as the area of communication of the second compression chambers 2*b* with the discharge port 30 and the opening area of the check valve assembly 35 are enlarged, the compressed refrigerant gas is discharged from the discharge port 30 to the discharge chamber 32.

Because the actual volume ratio (the ratio of the suction volume to the final volume of the compression chambers) is determined in consideration of the load condition at the rated operation of the compressor, if the bypass holes 39 are formed at locations considerably offset to the suction side compared with the aforementioned locations, the second compression chambers 2*b* become closed spaces in the movable range of the compression chambers after the orbiting scroll wrap 13*a* has passed the bypass holes 39 and before the second compression chambers 2*b* communicate with the discharge port 30. This reduces the substantial input reducing effects when the excessive compression occurs. In contrast, if the bypass holes 39 are formed at locations closer to the discharge port 30 than the aforementioned locations, and if the pressure difference between the suction pressure and the discharge pressure is large and the compression ratio at the actual load operation is greater than the preset compression ratio, for example, at a high speed operation of the compressor, the bypass holes 39 are closed by the orbiting scroll wrap 13*a* before the second compression chambers 2*b* communicate with the discharge port 30, thus reducing the bypass effect.

Because excessive compressions cannot be eliminated that would occur immediately before or after the second compression chambers 2*b* communicate with the discharge port 30, the input reducing effects caused by the bypass effect become small.

When the compressor is operated at a high speed under a high load, the temperature of the coil spring 41 increases with an increase of the discharge gas temperature, resulting in an increase in the biasing force against the bypass valve assembly 40. This increase of the biasing force enhances the performance of sealing between the bottom surface of the bypass discharge chamber 36 and the bypass valve assembly 40, and reduces the amount of leakage of the refrigerant gas from the discharge chamber 32 to the second compression chambers 2*b* through the second to fourth bypass holes 39*b*–39*d*.

On the other hand, when the compressor is operated at a low speed under a low load, the pressure difference between the suction pressure and the discharge pressure is small, and the compression ratio at the actual load operation is smaller than the preset compression ratio. Also, the communication of the second to fourth bypass holes 39*b*–39*d* with the bypass discharge chamber 36 is required to avoid the excessive compression condition in the compression chambers 2. In this case, because the temperature of the coil spring 41 is low, the biasing force thereof against the bypass valve assembly 40 is weak. Accordingly, the bypass valve assembly 40 quickly moves back to open the second to fourth bypass holes 39*b*–39*d*, thus avoiding the excessive compression in the compression chambers 2 and reducing the inputs.

It is to be noted here that although in the above-described embodiment the bypass holes 39 have been described as having, at their ends open to the second compression chambers 2*b*, a diameter smaller than the width W of the sealing member 13*e*, the diameter of the open ends of the bypass holes 39 can be increased to a value equal to the width of the sealing member 13*e* depending on the pressure load, operation speed or the amount of oil fed to the compression chambers 2. Even in such a case, because the lubricating oil forms oil films on the open ends of the bypass holes 39, a substantial reduction in compression efficiency is not caused.

It is also to be noted that although in the above-described embodiment the circumferential interval between the first bypass holes 39*a* and the corresponding second bypass holes 39*b* has been described as being less than 360°, if excessive compressions frequently occur in the second compression chambers 2*b*, the bypass effect can be enhanced by setting the circumferential interval between the first bypass holes 39*a* and the corresponding fourth bypass holes 39*d* to be less than 360°.

Figure 12:
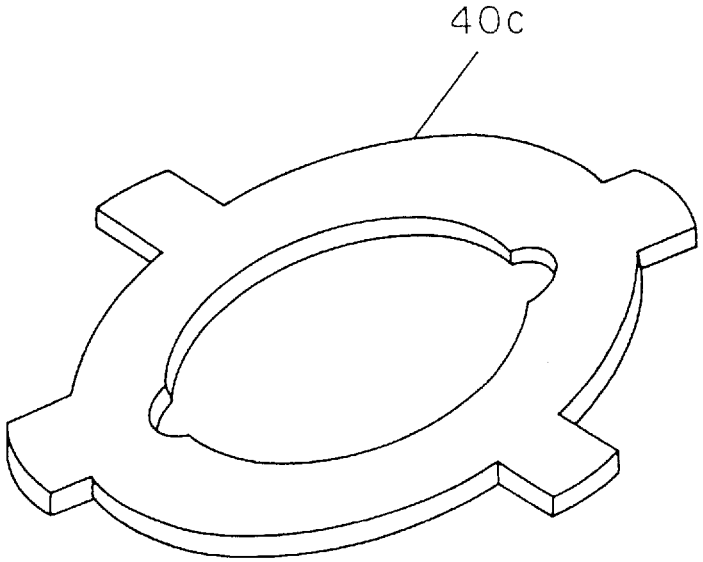
FIG. 12 is a perspective view of a bypass valve mounted in a scroll refrigerant compressor according to a second embodiment of the present invention.

FIG. 12 depicts an annular bypass valve assembly 40*c* employed in a horizontally arranged scroll refrigerant compressor according to a second embodiment of the present invention.

The annular bypass valve assembly 40*c* of FIG. 12 can be used in place of the bypass valve assembly 40, shown in FIG. 9, having the reed portions 40*b*. This bypass valve assembly 40*c* can open and close the second to fourth bypass holes 39*b*–39*d* simultaneously. Because the bypass valve assembly 40*c* has good opening and closing responsibilities at high speed operations of the compressor, the input reducing effect by the bypass action is enhanced.

Figure 13:
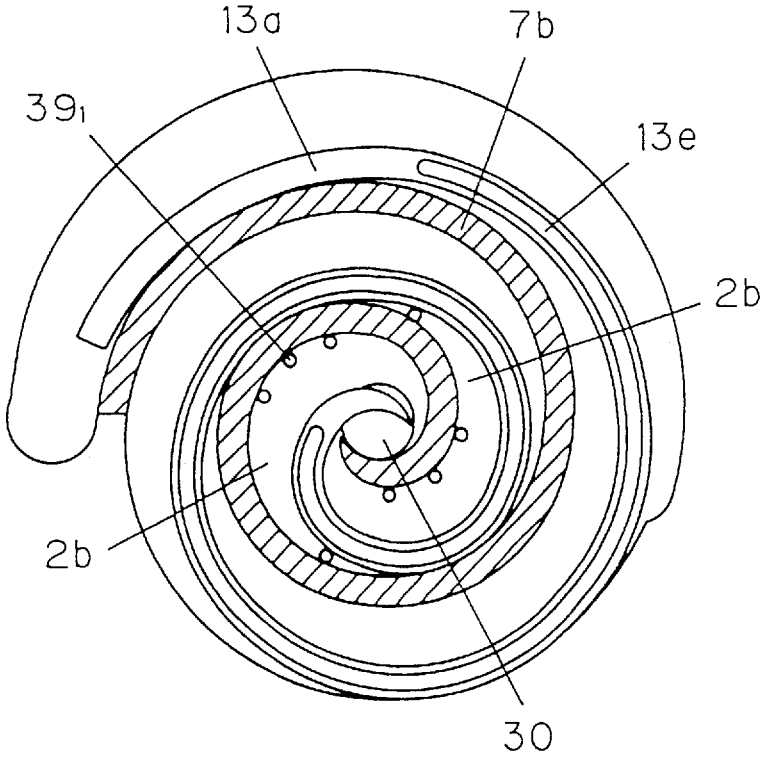
FIG. 13 is a view similar to FIG. 8, but depicting an arrangement of bypass holes defined in a scroll refrigerant compressor according to a third embodiment of the present invention.

FIG. 13 depicts a stationary scroll 7 and an orbiting scroll 13 employed in a horizontally arranged scroll refrigerant compressor according to a third embodiment of the present invention.

The stationary end plate 7*a* of the stationary scroll 7 has four bypass holes $\mathbf{39}_1$ defined therein on each side of the discharge port 30 to enhance the bypass action in the range of low compression ratios.

FIGS. 14 to 18 depict a horizontally arranged scroll refrigerant compressor according to a fourth embodiment of the present invention.

As shown in these figures, a stationary end plate 7*a* has a first bypass hole $\mathbf{39}_{a1}$ and a second bypass hole $\mathbf{39}_{b1}$ both defined therein on each side of the discharge port 30. The first and second bypass holes $\mathbf{39}_{a1}$ and $\mathbf{39}_{b1}$ are open to the second compression chambers 2*b* communicating intermittently with the discharge port 30 and to the discharge chamber 32, and have, at their ends open to the second compression chambers 2*b*, a diameter smaller than the width of the orbiting scroll wrap 13*a*. Also, the first and second bypass holes $\mathbf{39}_{a1}$ and $\mathbf{39}_{b1}$ are formed symmetrically along the wall surfaces of the stationary scroll wrap 7*b* so as to follow the progress of compression. A bypass valve assembly 40 for selectively opening and closing the first and second bypass holes $\mathbf{39}_{a1}$ and $\mathbf{39}_{b1}$ is mounted on the stationary end plate 7*a*.

The stationary end plate 7*a* also has an auxiliary bypass hole 49 defined therein on each side of the discharge port 30. The auxiliary bypass holes 49 are open to the first compression chambers 2*a* communicating intermittently with the suction chamber 31 and to the discharge chamber 32, and have, at their ends open to the first compression chambers 2*a*, a diameter smaller than the width of the orbiting scroll wrap 13*a*. Also, the first bypass holes $\mathbf{39}_{a1}$ are formed symmetrically at locations close to the wall surfaces of the stationary scroll wrap 7*b*. Auxiliary bypass valve assemblies 42 for selectively opening and closing the corresponding auxiliary bypass holes 49 are mounted on the stationary end plate 7*a*.

Figure 14:
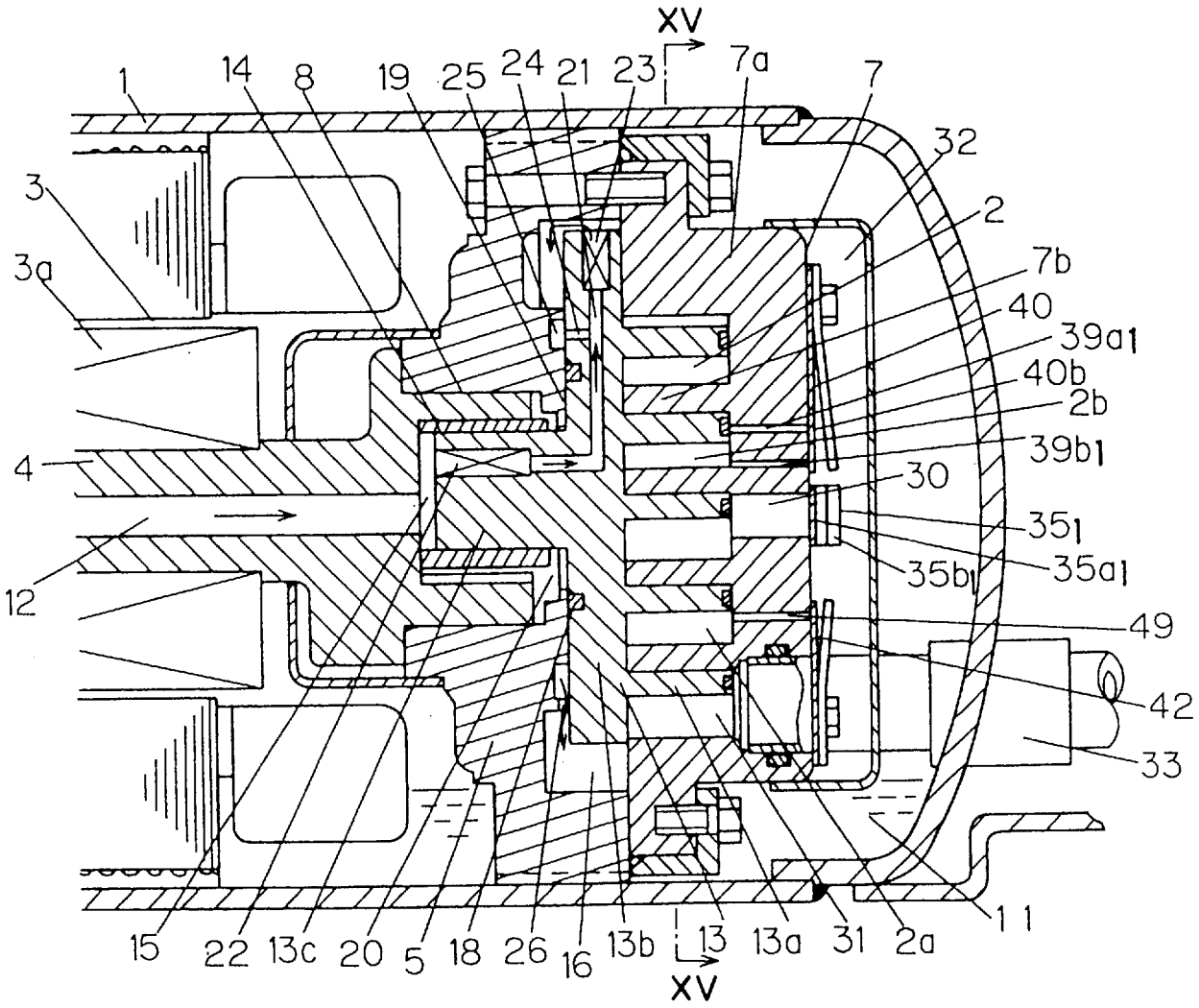
FIG. 14 is a fragmentary vertical sectional view of a scroll refrigerant compressor according to a fourth embodiment of the present invention.
Figure 15:
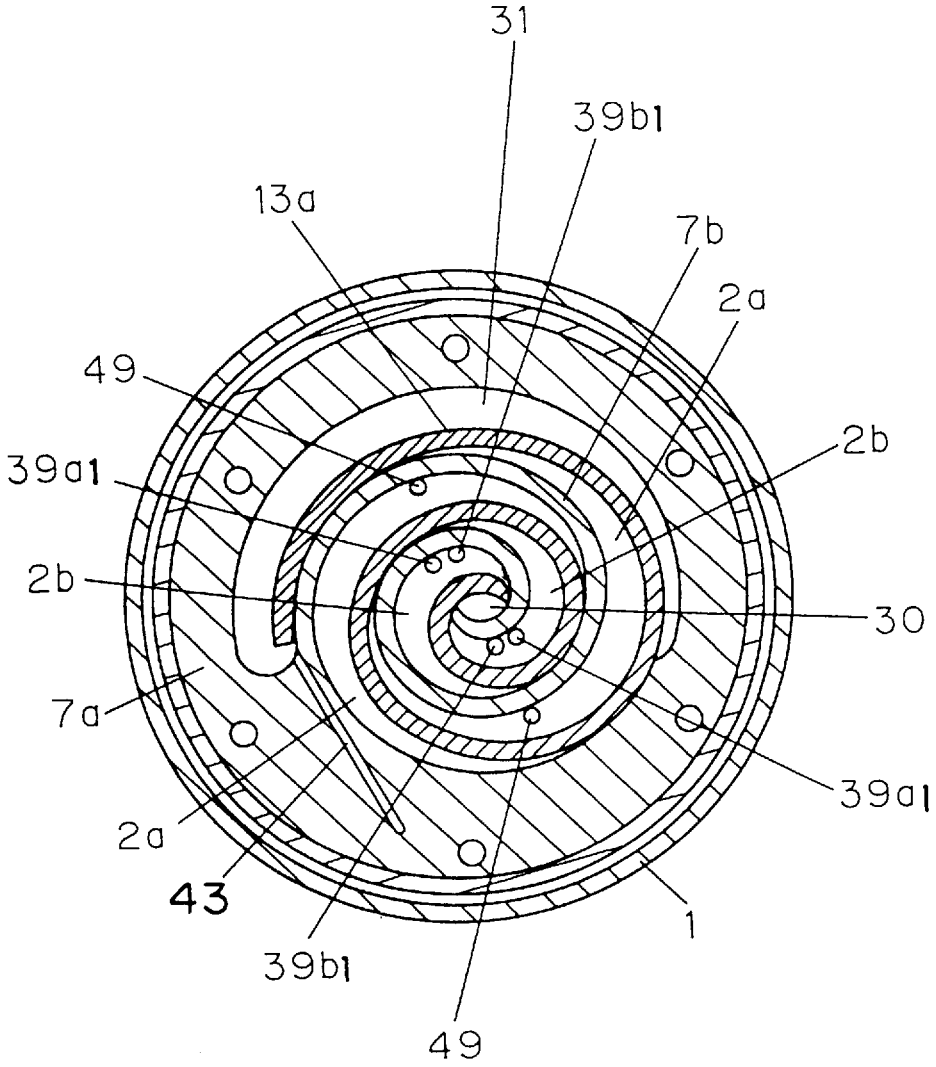
FIG. 15 is a sectional view taken along line XV—XV in FIG. 14.

FIG. 15 is a sectional view taken along line XV—XV in FIG. 14 and depicts the condition of compression chambers immediately before the second compression chambers 2*b* communicating intermittently with the discharge port 30 are open to the discharge port 30. The first and second bypass holes $\mathbf{39}_{a1}$ and $\mathbf{39}_{b1}$ are not closed, even partially, by the orbiting scroll wrap 13*a*.

Figure 16:
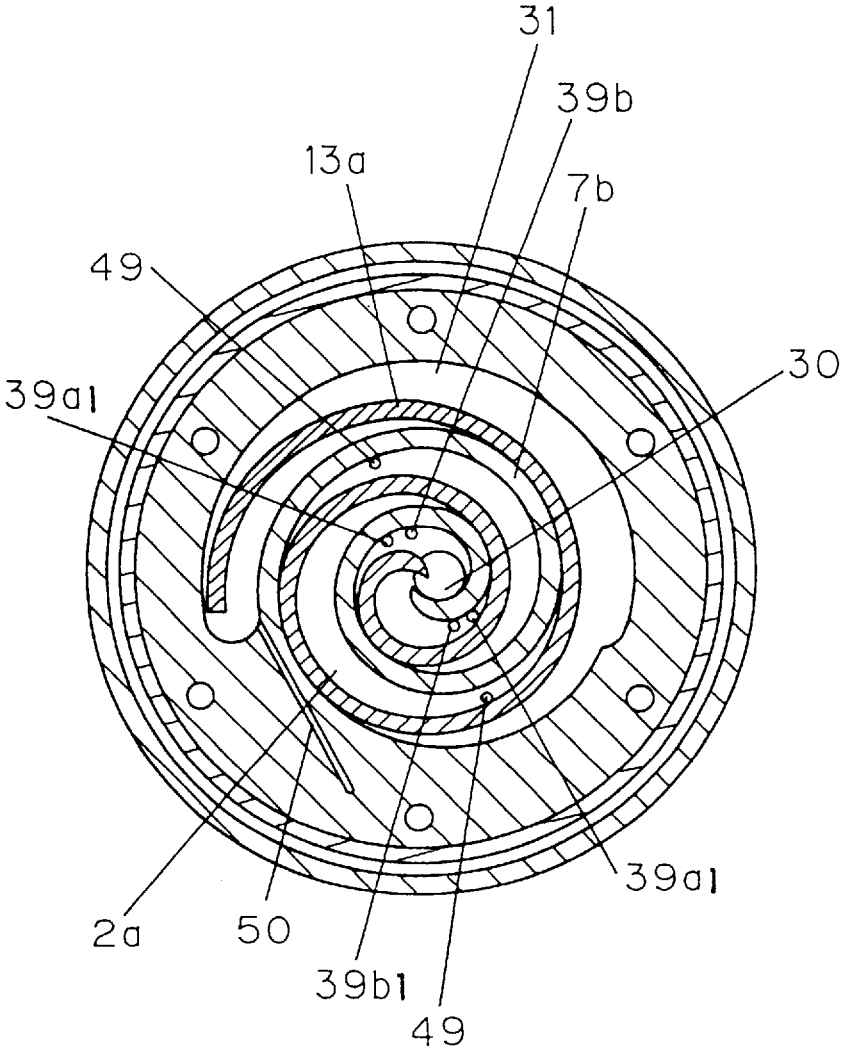
FIG. 16 is a view similar to FIG. 15, but depicting the condition in which the compression spaces have advanced 150° from the condition of FIG. 15.

FIG. 16 depicts the condition of the compression chambers when the orbiting scroll wrap 13*a* has advanced to a location spaced 150° from the condition shown in FIG. 15.

Under this condition, the first and second bypass holes $\mathbf{39}_{a1}$ and $\mathbf{39}_{b1}$ are not closed, even partially, by the orbiting scroll wrap 13*a* and, hence, the passages of the first and second bypass holes $\mathbf{39}_{a1}$ and $\mathbf{39}_{b1}$ are maintained open.

Figure 17A:
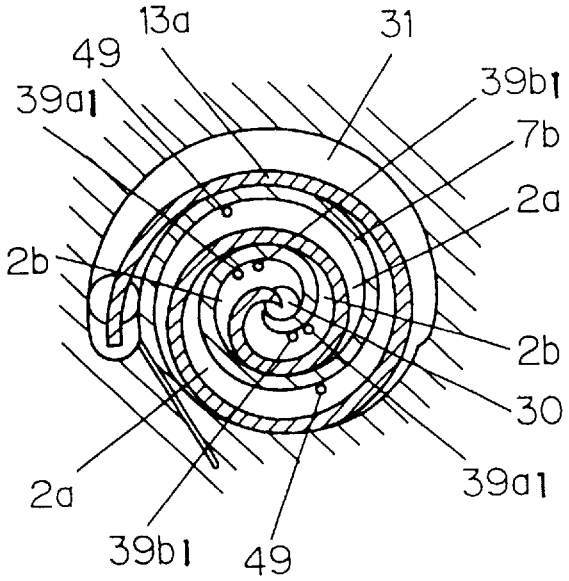
FIGS. 17A, 17B, 17C and 17D are each a view similar to FIG. 15, but depicting changes of the compression spaces with time.
Figure 17B:
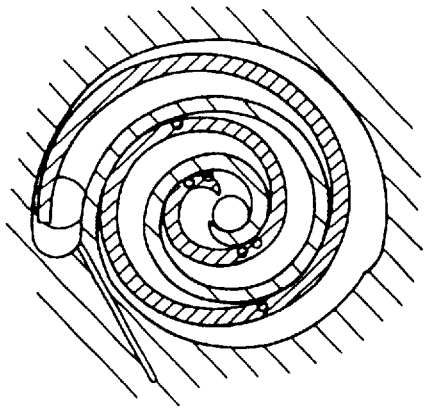

FIGS. 17A to 17D depict the conditions in which the first and second bypass holes $\mathbf{39}_{a1}$ and $\mathbf{39}_{b1}$ and the auxiliary bypass hole 49, shown in FIGS. 15 and 16, are selectively closed and opened with an orbiting motion of the orbiting scroll wrap 13*a*. FIG. 17A particularly shows an intermediate condition between the condition of FIG. 15 and that of FIG. 16.

Figure 18:
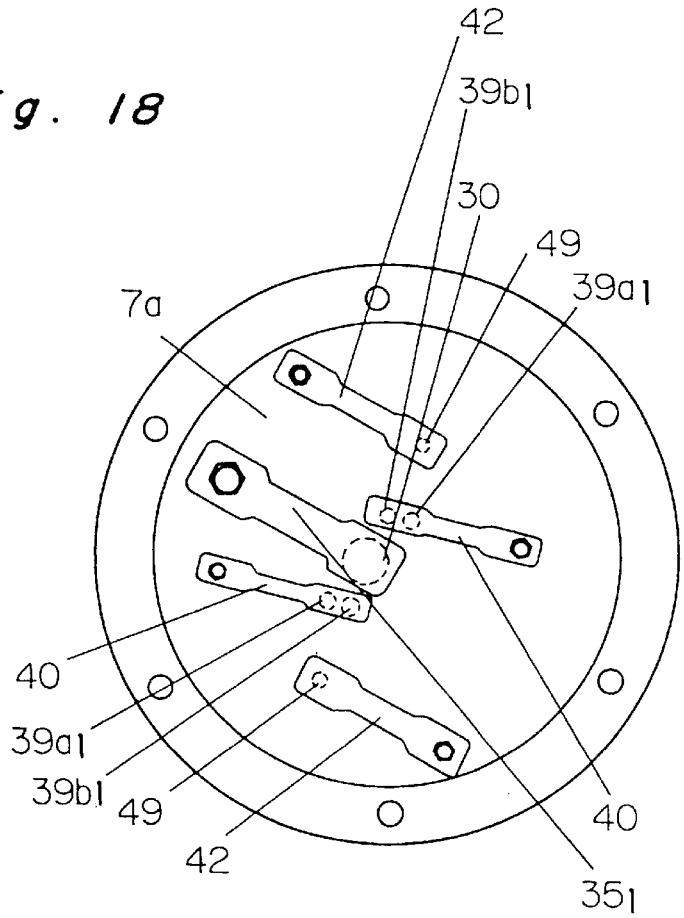
FIG. 18 is a top plan view of a stationary scroll depicting an arrangement of a check valve assembly, bypass valve assemblies, and auxiliary bypass valve assemblies.

FIG. 18 depicts a valve arrangement in which a check valve assembly $\mathbf{35}_1$, bypass valve assemblies 40, and auxiliary bypass valve assemblies 42 are mounted on the stationary end plate 7*a*.

Because the structure except above is the same as that shown in FIG. 5, explanation thereof is omitted here for brevity's sake.

The scroll refrigerant compressor according to the fourth embodiment of the present invention operates as follows.

As shown in FIGS. 15, 16 and 18, if liquid compression occurs in the first compression chambers 2*a* communicating intermittently with the suction chamber 31, the auxiliary bypass valve assemblies 42 closing the auxiliary bypass holes 49 and the bypass valve assemblies 40 closing the first and second bypass holes $\mathbf{39}_{a1}$ and $\mathbf{39}_{b1}$ are successively opened to introduce the refrigerant into the discharge chamber 32, thus reducing the pressure inside the compression chambers. On the other hand, if liquid compression occurs in the second compression chambers 2*b* communicating intermittently with the discharge port 30, the bypass valve assemblies 40 closing the first and second bypass holes $\mathbf{39}_{a1}$ and $\mathbf{39}_{b1}$ are opened to introduce the refrigerant into the discharge chamber 32, thus reducing the pressure inside the compression chambers.

Even if the liquid compression occurs in any of the compression chambers 2, at least one of the auxiliary bypass valve assemblies 42 and the bypass valve assemblies 40 is opened without fail, because the bypass holes are arranged such that each of the compression chambers 2 communicates with one of the first and second bypass holes $\mathbf{39}_{a1}$ and $\mathbf{39}_{b1}$ and the auxiliary bypass holes 49.

Similarly at high speed operations of the compressor, the bypass valve assemblies 40 open the first and second bypass holes $\mathbf{39}_{a1}$ and $\mathbf{39}_{b1}$ to discharge part of the excessively compressed refrigerant gas into the discharge chamber 32, resulting in a reduction in pressure of the compression chambers.

Because the opening of the bypass holes $\mathbf{39}_{a1}$ by the bypass valve assemblies 40 advances the timing of refrigerant gas discharge from the second bypass holes $\mathbf{39}_{b1}$ to the discharge chamber 32, the pressure inside the compression chambers reduces quickly to thereby reduce an excessive compression loss.

Moreover, because the first and second bypass holes $\mathbf{39}_{a1}$ and $\mathbf{39}_{b1}$ are not positioned very close to the discharge port 30, they are not closed by the orbiting scroll wrap 13*a* and achieve the bypass action even immediately before the second compression chambers 2*b* communicate with the discharge chamber 32.

In addition, even when the orbiting scroll wrap 13*a* has advanced to a location spaced 150° from the condition immediately before the second compression chambers 2*b* communicate with the discharge chamber 32, the first and second bypass holes $\mathbf{39}_{a1}$ and $\mathbf{39}_{b1}$ are not closed by the orbiting scroll wrap 13*a*. Although the first and second bypass holes $\mathbf{39}_{a1}$ and $\mathbf{39}_{b1}$ are successively momentarily closed by the orbiting scroll wrap 13*a* at a location between immediately before the second compression chambers 2*b* communicated with the discharge chamber 32 and when the orbiting scroll wrap 13*a* has advanced 150° therefrom, the second compression chambers 2*b* are not completely closed after the orbiting scroll wrap 13*a* has passed through the first and second bypass holes $\mathbf{39}_{a1}$ and $\mathbf{39}_{b1}$. Accordingly, the first and second bypass holes $\mathbf{39}_{a1}$ and $\mathbf{39}_{b1}$ always achieve an effective bypass action against the excessive compression phenomenon occurring in the compression chambers 2.

Also, because the first and second bypass holes $\mathbf{39}_{a1}$ and $\mathbf{39}_{b1}$ have an appropriate size or shape and are spaced from each other at an appropriate interval, the period of time during which the first and second bypass holes $\mathbf{39}_{a1}$ and $\mathbf{39}_{b1}$ are closed simultaneously by the orbiting scroll wrap 13*a* can be shortened, thus making it possible to prolong the effectiveness of the bypass action. That is, when the second compression chambers 2*b* have communicated with the discharge chamber 32, pressure changes in the second compression chambers 2*b* can be reduced by causing the first and second bypass holes $\mathbf{39}_{a1}$ and $\mathbf{39}_{b1}$ to continue the bypass action, thus reducing noise of the compressed refrigerant flowing out to the discharge chamber 32, noise generated by the check valve assembly $\mathbf{35}_1$, and pulsation of the discharged refrigerant.

Immediately after the stop of the compressor operation, the remaining pressure difference causes the lubricating oil in the oil sump 11 to flow into the first compression chambers 2*a* through the oil hole 12, the oil passage 21, the third back chamber 16 and the suction chamber 31. As a result, there is a good chance that oil compression occurs in the first compression chambers 2*a* when the compressor is restarted. As a matter of course, the compressed lubricating oil is discharged into the discharge chamber 32 through the auxiliary bypass holes 49. Thereafter, a smooth compressor operation is continued.

It is to be noted that the pressure inside the third back chamber 16 leading to the suction chamber 31 can be set, by the passage resistance between the suction chamber 31 and the third back chamber 16, to a value substantially equal to the suction pressure or an intermediate pressure between the suction pressure and the discharge pressure.

It is also to be noted that although in the above-described embodiment one auxiliary bypass hole 49 is disposed on each side of the discharge port 30 so that the two auxiliary bypass holes 49 on respective sides of the discharge port 30 can have a symmetrical relation to each other with respect to such discharge port 30, a plurality of auxiliary bypass holes may be disposed on each side of the discharge port 30 so that they can similarly have a symmetrical relation to each other. In this case, the plurality of auxiliary bypass holes may be opened and closed by a single auxiliary bypass valve assembly 42.

Figure 19:
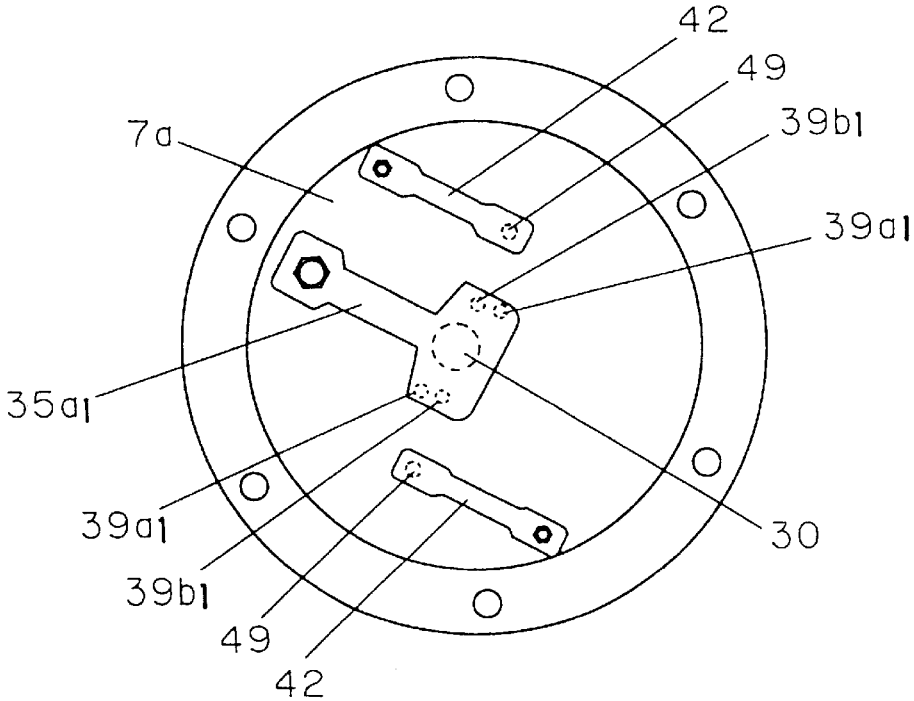
FIG. 19 is a view similar to FIG. 18, but according to a fifth embodiment of the present invention.

FIG. 19 depicts a check valve assembly $\mathbf{35}_{a1}$ employed in a scroll refrigerant compressor according to a fifth embodiment of the present invention. The check valve assembly $\mathbf{35}_{a1}$ has one-piece construction into which the check valve assembly $\mathbf{35}_1$ and the bypass valve assemblies 40, both shown in FIG. 18, are combined.

When the refrigerant gas being compressed in the second compression chambers 2*b* is partially discharged into the discharge chamber 32 through the first and second bypass holes $\mathbf{39}_{a1}$ and $\mathbf{39}_{b1}$, the check valve assembly $\mathbf{35}_{a1}$ closing the discharge port 30 starts opening. Immediately after the second compression chambers 2*b* communicate with the discharge port 30, the completely compressed refrigerant gas is discharged into the discharge chamber 32 through the discharge port 30 without delay. Because of this, the pressure inside the discharge port 30 does not excessively increase after the completion of the compression operation, thus reducing compression inputs.

It is to be noted that although in FIG. 19 the check valve assembly $\mathbf{35}_{a1}$ and the auxiliary bypass valve assemblies 42 are separated from each other, they may be integrally connected together.

Figure 20:
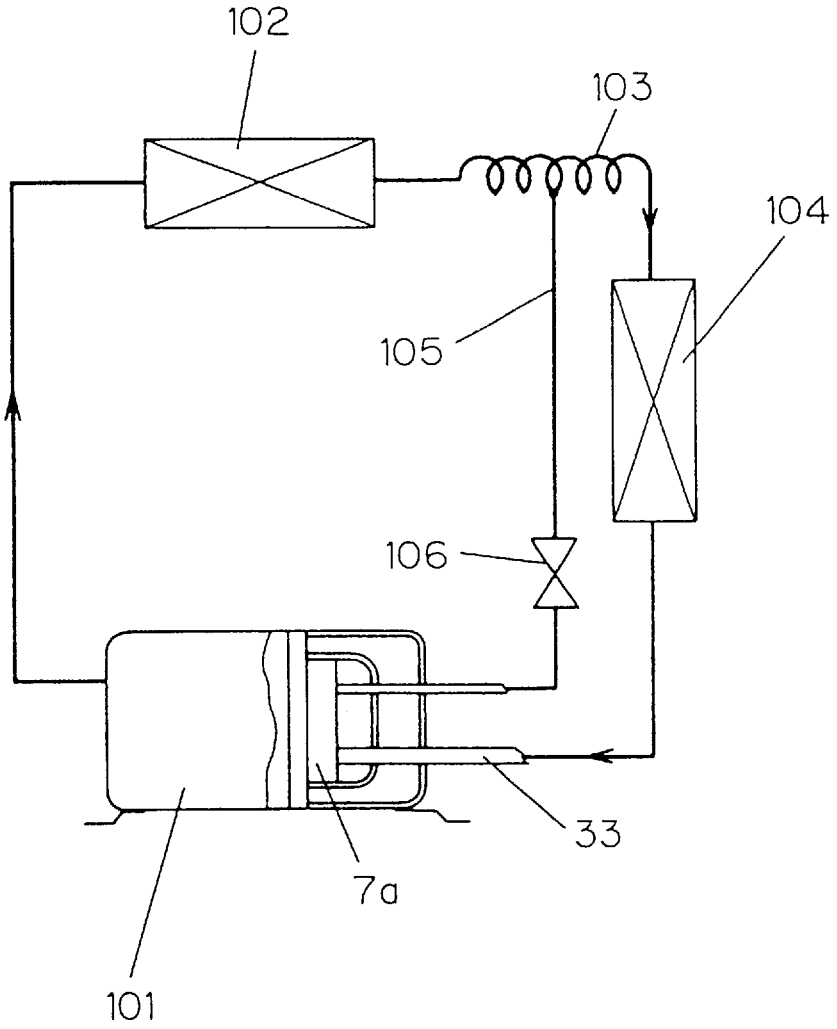
FIG. 20 is a piping diagram of a refrigerating cycle in which a scroll refrigerant compressor according to a sixth embodiment of the present invention is incorporated.
Figure 21:
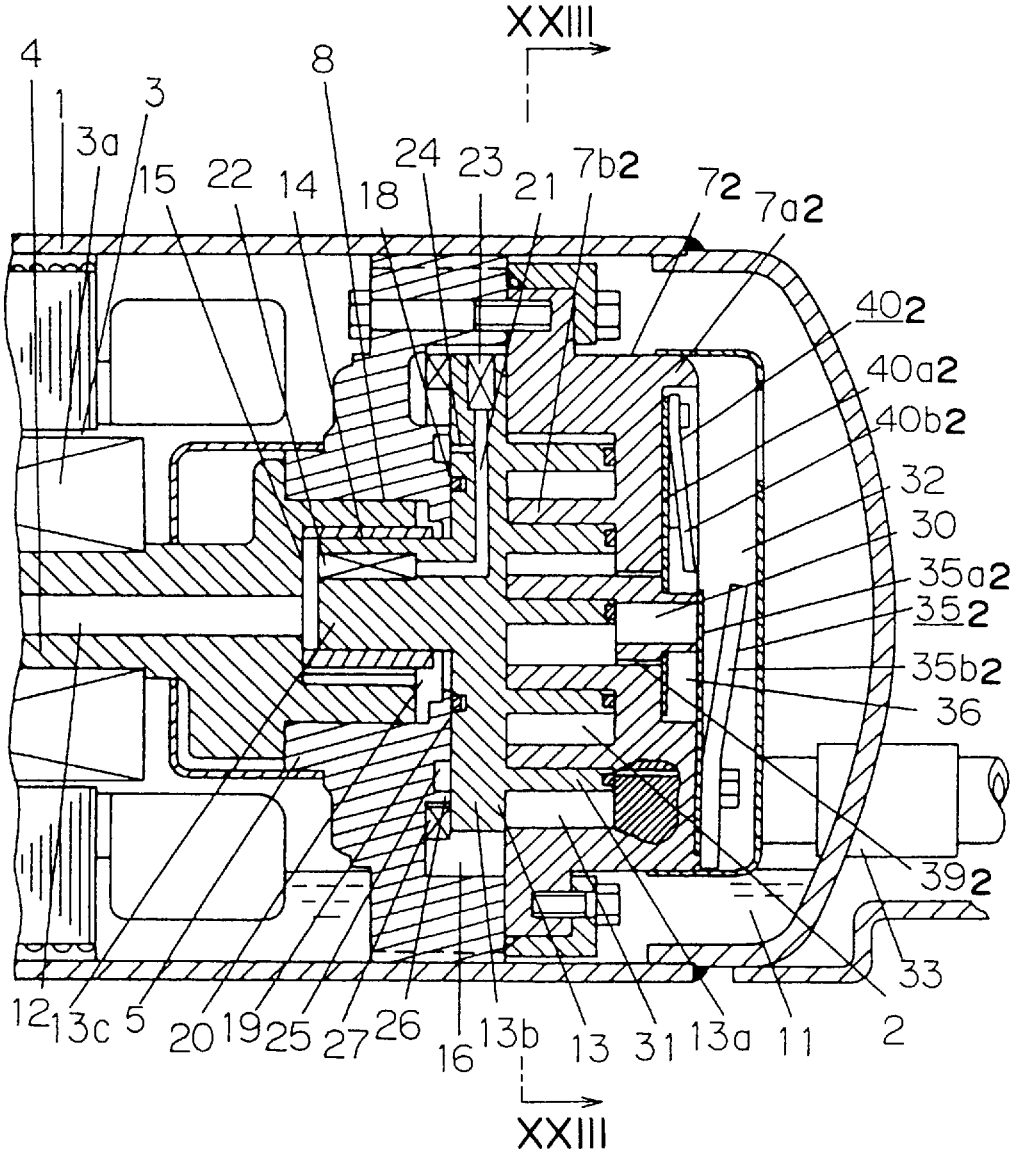
FIG. 21 is a fragmentary vertical sectional view of a scroll refrigerant compressor according to a seventh embodiment of the present invention.

A sixth embodiment of the present invention is discussed hereinafter with reference to FIG. 20. As shown therein, the compression chambers of the scroll refrigerant compressor 101 are communicated with an intermediate portion of a pressure reducing device 103 mounted in a refrigerating cycle piping system via a refrigerant injection pipe 105 having a valve 106 such as, for example, a solenoid valve.

By this construction, when the compression ratio during compressor operations is greater than the preset compression ratio (insufficient compression condition), the refrigerant liquefied by a condenser 102 is first reduced in pressure to a vapor-liquid mixed refrigerant having an intermediate pressure between the discharge pressure and the suction pressure, which is in turn drawn into the compression chambers, by opening the valve 106.

Figure 17C:
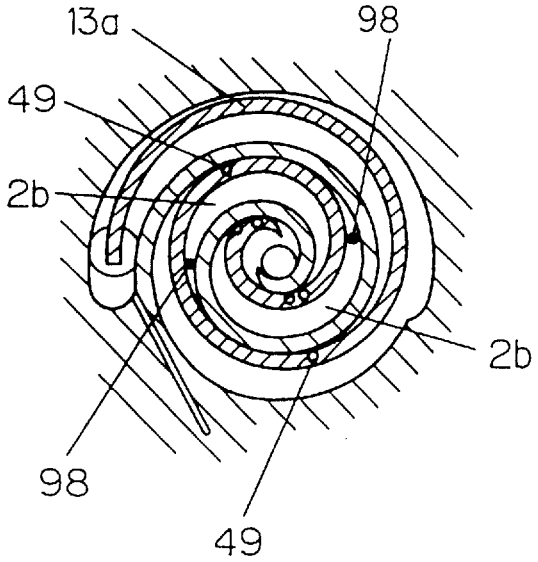
Figure 17D:
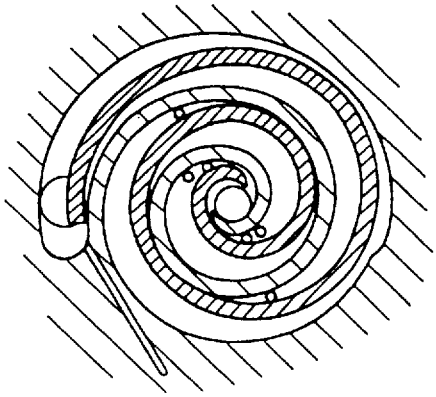

The refrigerant injection pipe 105 communicates with the second compression chambers 2*b* via two injection holes 98 defined in the stationary end plate 7*a* along the wall surfaces of the stationary scroll wrap 7*b*. As shown in FIG. 17C, the two injection holes 98 are symmetrically disposed on respective sides of the discharge port 30 and are open to the second compression chambers 2*b* at locations between the first bypass holes $\mathbf{39}_{a1}$ and the auxiliary bypass holes 49. The diameter of the injection holes 98 is determined such that the injection holes 98 are selectively opened and closed by the orbiting scroll wrap 13*a*.

In the above-described construction, when the compression ratio during compressor operations is greater than the set compression ratio (insufficient compression condition), part of the vapor-liquid mixed refrigerant first flows into the second compression chambers 2*b* and subsequently joins the refrigerant gas that has passed through the suction chamber 31 and is now being compressed. Thereafter, such refrigerant cools the compression portion and enhances the pressure after compression, thus cancelling the insufficient compression condition and increasing the pressure inside the discharge chamber 32. Also, because the refrigerant gas having passed through the discharge chamber 32 reduces the temperature of the electric motor 3, the motor efficiency is enhanced. When the refrigerating cycle is used in an air conditioner for a warming operation, the pressure increase in the discharge chamber 32 increases the temperature of air blown into a room to thereby enhance the warming capacity.

If the pressure of the refrigerant gas being compressed is higher than the pressure inside the discharge chamber 32, the refrigerant gas is partially discharged into the discharge chamber 32 through the first and second bypass holes $\mathbf{39}_{a1}$ and $\mathbf{39}_{b1}$, as in the above case, thus avoiding the excessive compression.

When the compression ratio during compressor operations is smaller than the set compression ratio, the valve 106 is closed to stop the refrigerant injection action. As a matter of course, immediately after the compressor is started or after the compressor is stopped, the valve 106 is closed and, hence, the refrigerant liquid compression is prevented, thus lightening the starting load.

A seventh embodiment of the present invention is discussed hereinafter with reference to FIGS. 21 to 25.

As shown in FIGS. 21 to 25, a check valve assembly $\mathbf{35}_2$ comprising a reed valve $\mathbf{35}_{a2}$ made of a thin steel plate and a valve retainer $\mathbf{35}_{b2}$ for selectively opening and closing the discharge port 30 is mounted on the flat surface of a stationary end plate $\mathbf{7}_{a2}$ of a stationary scroll $\mathbf{7}_2$. The stationary end plate $\mathbf{7}_{a2}$ has a recess defined therein around the discharge port 30. This recess adjoins the check valve assembly $\mathbf{35}_2$ and is used as a bypass discharge chamber 36.

The stationary end plate $\mathbf{7}_{a2}$ also has a plurality of bypass holes $\mathbf{39}_2$ defined therein at a central portion thereof close to the discharge port 30. The bypass holes $\mathbf{39}_2$ are open to the second compression chambers 2*b* communicating intermittently with the discharge port 30 and also to the bypass discharge chamber 36. A bypass valve assembly $\mathbf{40}_2$ for selectively opening and closing the bypass holes $\mathbf{39}_2$ is mounted on the bottom of the bypass discharge chamber 36. The bypass valve assembly $\mathbf{40}_2$ comprises a reed valve $\mathbf{40}_{a2}$ made of a thin steel plate and a valve retainer $\mathbf{40}_{b2}$.

The bypass holes $\mathbf{39}_2$ include two second bypass holes $\mathbf{39}_{b2}$, two third bypass holes $\mathbf{39}_{c2}$, and two fourth bypass holes $\mathbf{39}_{d2}$. The bypass holes $\mathbf{39}_2$ on one side of the discharge port 30 are positioned symmetrically with those on the other side of the discharge port 30 so as to follow the progress of compression.

The reed valve $\mathbf{40}_{a2}$ has a ring-shaped head portion $\mathbf{40}_{a21}$ which encircles the discharge port 30 and can close all of the second to fourth bypass holes $\mathbf{39}_{b2}$–$\mathbf{39}_{d2}$.

Figure 22:
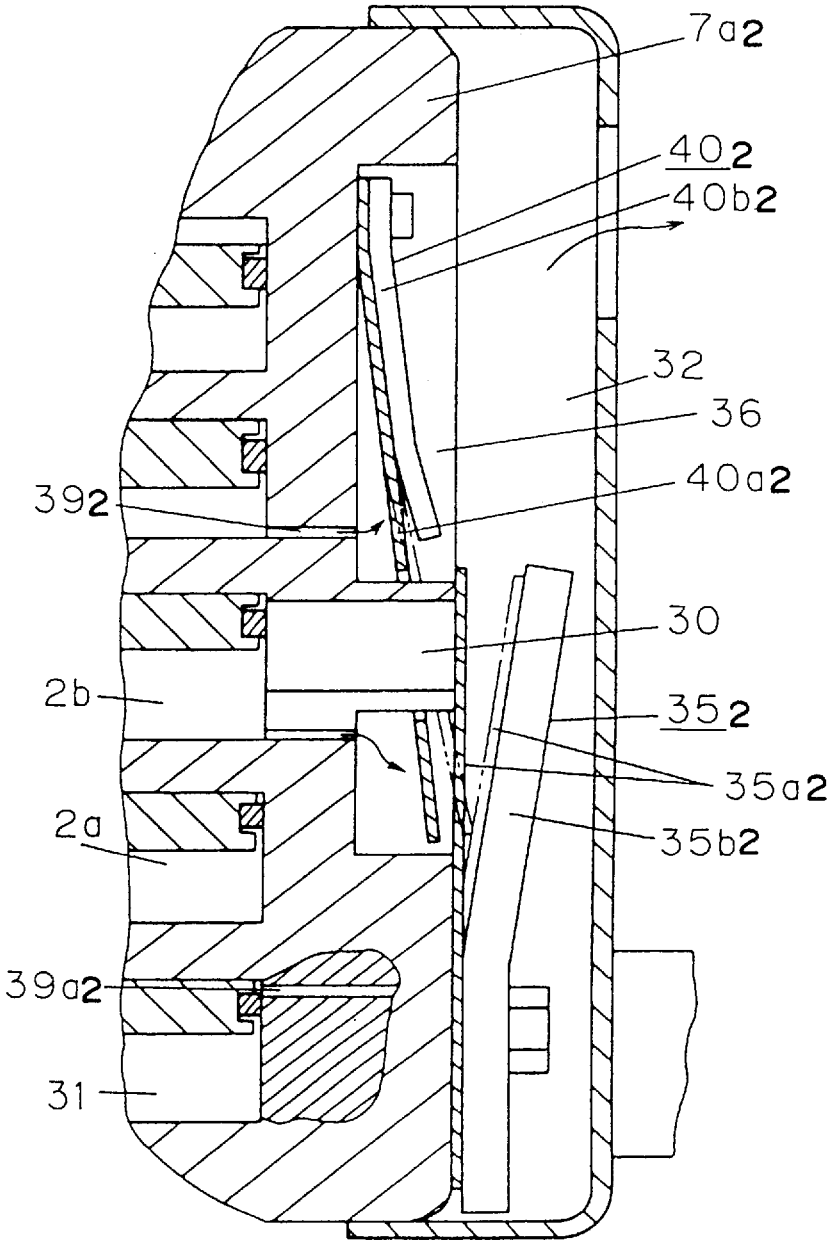
FIG. 22 is a fragmentary vertical sectional view of an essential portion of the scroll refrigerant compressor of FIG. 21 under the condition in which bypass holes are opened.

When the reed valve $\mathbf{40}_{a2}$ closing the bypass holes $\mathbf{39}_2$ is opened to its upper limit, as shown by double-dotted chain lines in FIG. 22, the reed valve $\mathbf{40}_{a2}$ pushes up the reed valve $\mathbf{35}_{a2}$ of the check valve assembly $\mathbf{35}_2$. That is, the bypass valve assembly $\mathbf{40}_2$ and the check valve assembly $\mathbf{35}_2$ are in positional relationship so that the closing of the discharge port 30 by the check valve assembly $\mathbf{35}_2$ can be released by the bypass valve assembly $\mathbf{40}_2$.

The stationary end plate $\mathbf{7}_{a2}$ has two first bypass holes $\mathbf{39}_{a2}$ defined therein and positioned symmetrically with respect to the discharge port 30. The first bypass holes $\mathbf{39}_{a2}$ are open to the first compression chamber 2*a* communicating intermittently with the suction chamber 31 and also to the discharge chamber 32. Two auxiliary bypass valve assemblies 42 for selectively opening and closing the corresponding first bypass holes $\mathbf{39}_{a2}$ are mounted on the stationary end plate $\mathbf{7}_{a2}$.

Because the structure except above is the same as that shown in FIG. 5, explanation thereof is omitted here for brevity's sake.

The scroll refrigerant compressor of the above-described construction operates as follows.

Figure 23:
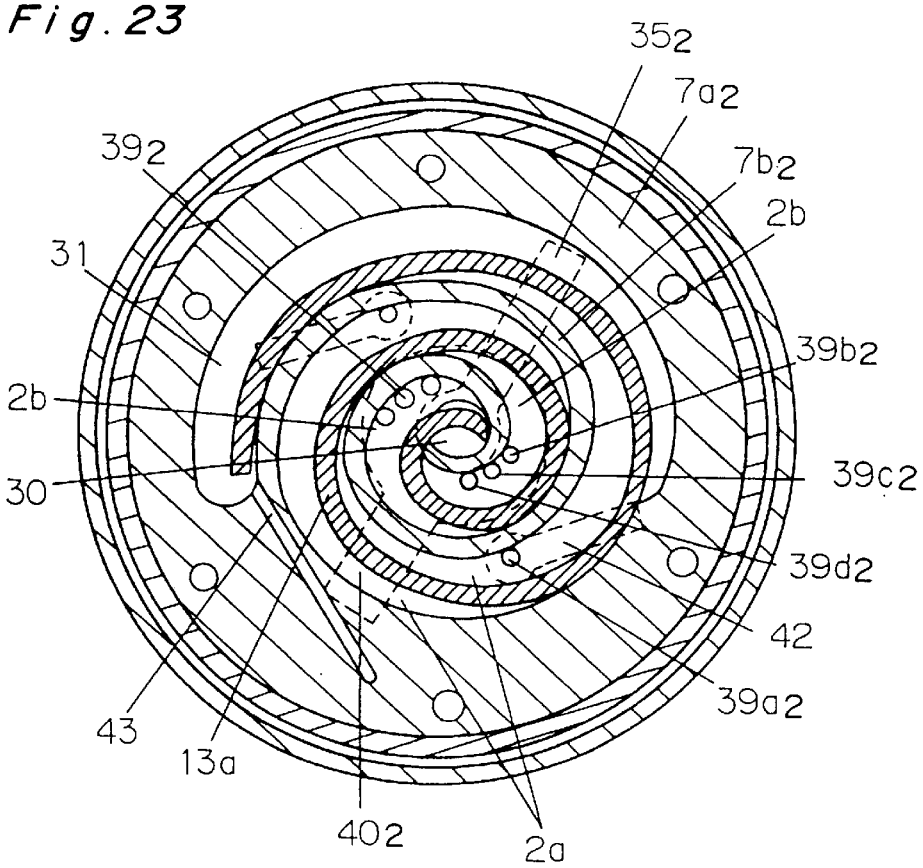
FIG. 23 is a sectional view taken along line XXIII—XXIII in FIG. 21.
Figure 24:
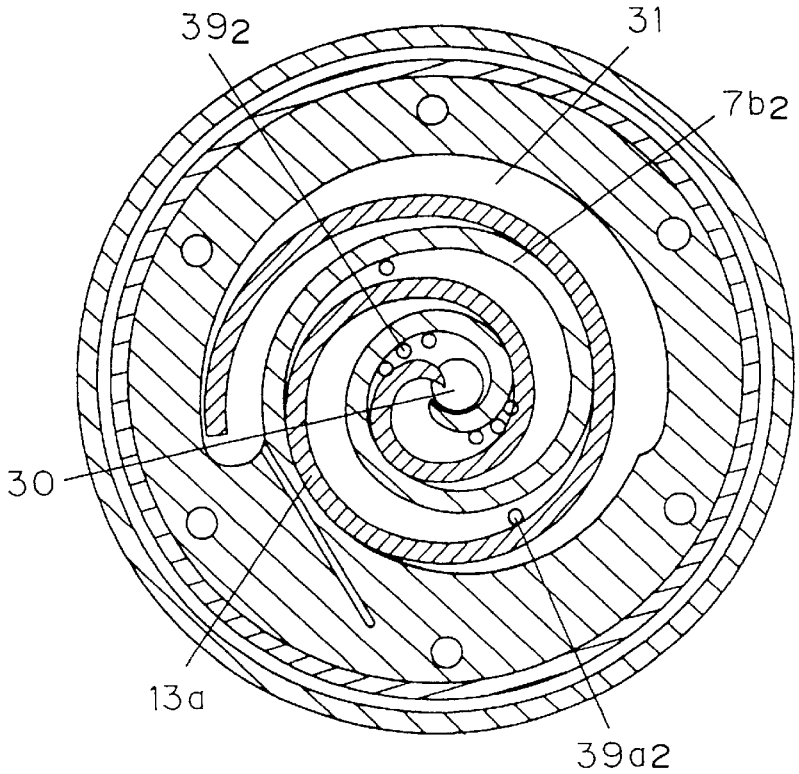
FIG. 24 is a view similar to FIG. 23, but depicting the condition in which the compression chambers have advanced 90° from the condition of FIG. 23.
Figure 25:
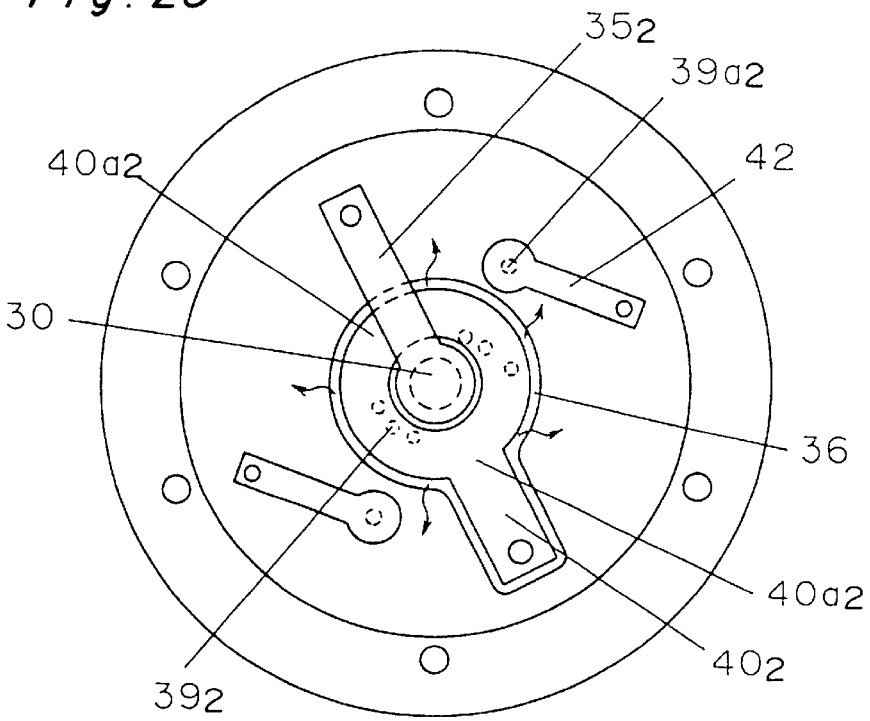
FIG. 25 is a top plan view of a stationary scroll mounted in the scroll refrigerant compressor of FIG. 21, particularly depicting an arrangement of a check valve assembly, a bypass valve assembly, and auxiliary bypass valve assemblies.

As shown in FIG. 22, if liquid compression occurs in the first compression chambers 2*a* communicating intermittently with the suction chamber 31, the auxiliary bypass valve assemblies 42 closing the first bypass holes $\mathbf{39}_{a2}$ and the bypass valve assembly $\mathbf{40}_2$ closing the second to fourth bypass holes $\mathbf{39}_{b2}$–$\mathbf{39}_{d2}$ are successively opened to discharge the refrigerant into the discharge chamber 32, as shown in FIGS. 23 to 25, thus reducing the pressure inside the compression chambers.

If the liquid compression occurs in the second compression chambers 2*b* communicating intermittently with the discharge port 30, the reed valve $\mathbf{40}_{a2}$ of the bypass valve assembly $\mathbf{40}_2$ closing the second to fourth bypass holes $\mathbf{39}_{b2}$–$\mathbf{39}_{d2}$ is opened, as shown in FIG. 22. As a result, the reed valve $\mathbf{35}_{a2}$ of the check valve assembly $\mathbf{35}_2$ opens the discharge port 30, as shown by the double-dotted chain lines.

Because the check valve assembly $\mathbf{35}_2$ receives no passage resistance under a condition between the condition shown in FIG. 23 immediately after the second compression chambers 2*b* communicate with the discharge port 30 and the condition shown in FIG. 24 in which the orbiting scroll wrap 13*a* has further advanced by 90°, the compressed refrigerant gas is smoothly discharged from the discharge port 30 and the bypass holes $\mathbf{39}_2$. Accordingly, the compressed refrigerant gas is continuously discharged into the discharge chamber 32 from before the second compression chambers 2*b* communicate with the discharge port 30 and, hence, no excessive compression occurs inside the second compression chambers 2*b* and the discharge port 30.

Furthermore, because the compressed refrigerant gas is continuously discharged from the second compression chambers 2*b* to the discharge port 30 and then to the discharge chamber 32 from before the second compression chambers 2*b* communicate with the discharge port 30, noise of the compressed refrigerant gas flowing out to the discharge chamber 32 and pressure pulsation inside the discharge chamber 32 are reduced, thus reducing noise and vibration of the compressor.

Also, because the second to fourth bypass holes $\mathbf{39}_{b2}$–$\mathbf{39}_{d2}$ are positioned so as not to be closed simultaneously by the free end of the orbiting scroll wrap 13*a*, the bypass valve assembly $\mathbf{40}_2$ for simultaneously opening and closing the second to fourth bypass holes $\mathbf{39}_{b2}$–$\mathbf{39}_{d2}$ operates so as to open continuously.

The use of a recess defined in the stationary end plate $\mathbf{7}_{a2}$ as the bypass discharge chamber 36 shortens the length of the second to fourth bypass holes $\mathbf{39}_{b2}$–$\mathbf{39}_{d2}$. As a result, the pressure loss which may be caused by reexpansion and recompression of the refrigerant gas remaining inside the bypass holes $\mathbf{39}_2$ is reduced to the extent of being negligible.

Figure 27:
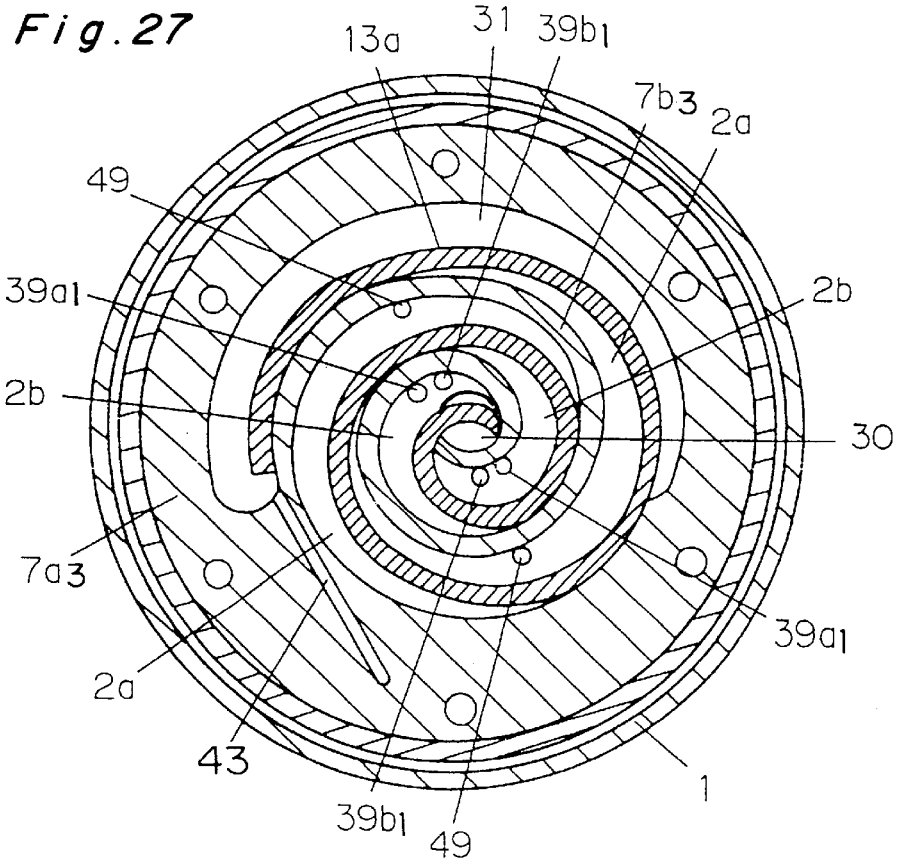
FIG. 27 is a sectional view taken along line XXVII—XXVII in FIG. 26.
Figure 26:
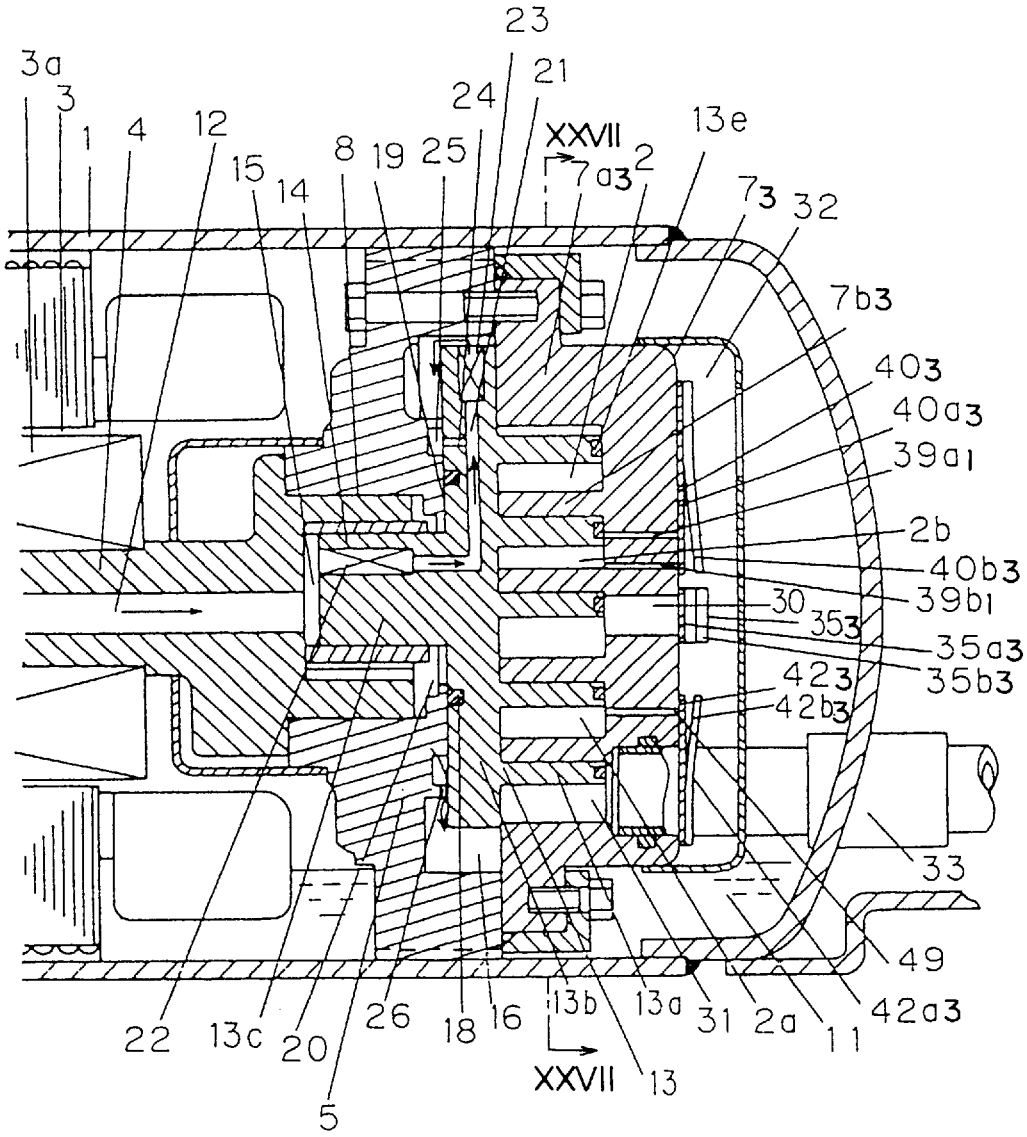
FIG. 26 is a fragmentary vertical sectional view of a scroll refrigerant compressor according to an eighth embodiment of the present invention.
Figure 28:
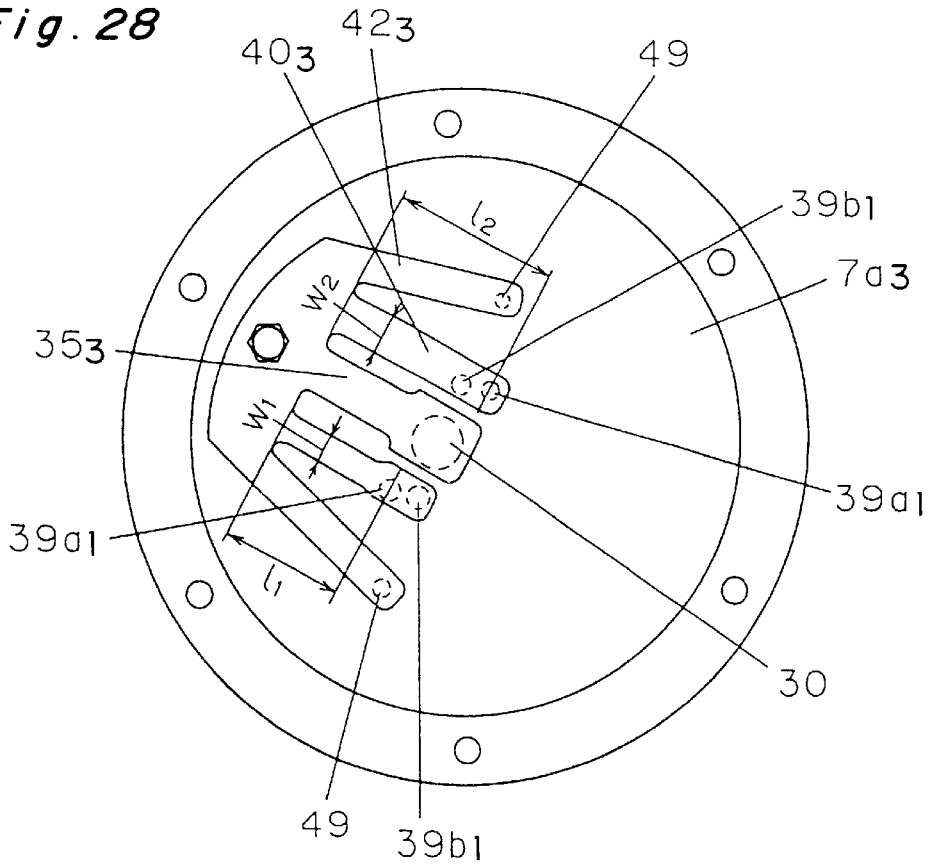
FIG. 28 is a view similar to FIG. 25, but depicting the stationary scroll mounted in the scroll refrigerant compressor of FIG. 26.

FIGS. 26 to 28 depict a scroll refrigerant compressor according to an eighth embodiment of the present invention.

As shown in FIGS. 26 to 28, a check valve assembly $\mathbf{35}_3$ comprising a reed valve $\mathbf{35}_{a3}$ made of a thin steel plate and a valve retainer $\mathbf{35}_{b3}$ for selectively opening and closing the discharge port 30 is mounted on the flat surface of the stationary end plate $\mathbf{7}_{a3}$ of the stationary scroll $\mathbf{7}_3$. The stationary end plate $\mathbf{7}_{a3}$ has a plurality of bypass holes 39 defined therein generally at a central portion thereof. The bypass holes 39 are open to the second compression chambers 2*b* communicating intermittently with the discharge port 30 and also to the discharge chamber 32. Each of the bypass holes 39 has, at its end open to the second compression chamber 2*b*, a diameter smaller than the width W of the sealing member 13*e* mounted on the free end of the orbiting scroll wrap 13*a*.

The bypass holes 39 include two first bypass holes $\mathbf{39}_{a1}$ and two second bypass holes $\mathbf{39}_{b1}$. The bypass holes 39 on one side of the discharge port 30 are positioned symmetrically with those on the other side of the discharge port 30. The bypass holes 39 are formed along the wall surfaces of the stationary scroll wrap $\mathbf{7}_{b3}$ so as to follow the progress of compression. Further, on each side of the discharge port 30, the first bypass hole $\mathbf{39}_{a1}$ and the second bypass hole $\mathbf{39}_{b1}$ are appropriately spaced from each other so that both of them may not be closed simultaneously by the sealing member 13*e*.

Each first bypass hole $\mathbf{39}_{a1}$ and the neighboring second bypass hole $\mathbf{39}_{b1}$ are selectively opened and closed by a reed type bypass valve assembly $\mathbf{40}_3$ mounted on the stationary end plate $\mathbf{7}_{a3}$. The bypass valve assembly $\mathbf{40}_3$ comprises a reed valve $\mathbf{40}_{a3}$ made of a thin steel plate and a valve retainer $\mathbf{40}_{b3}$.

FIG. 27 is a sectional view taken along line XXVII—XXVII and depicts the condition of the compression spaces immediately after the second compression chambers 2*b* communicating intermittently with the discharge port 30 has been opened thereto.

The stationary end plate $\mathbf{7}_{a3}$ has two auxiliary bypass holes 49 defined therein symmetrically on respective sides of the discharge port 30. The auxiliary bypass holes 49 are open to the first compression chambers 2*a* communicating intermittently with the suction chamber 31 and also to the discharge chamber 32, and each of the auxiliary bypass holes 49 is selectively opened and closed by an auxiliary bypass valve assembly $\mathbf{42}_3$ comprising a reed valve $\mathbf{42}_{a3}$ made of a thin steel plate and a valve retainer $\mathbf{42}_{b3}$.

As shown in FIG. 28, the check valve assembly $\mathbf{35}_3$, bypass valve assemblies $\mathbf{40}_3$, and auxiliary bypass valve assemblies $\mathbf{42}_3$ extend substantially in the same direction and are integrally connected together and bolted to the stationary end plate $\mathbf{7}_{a3}$.

Because the first and second bypass holes $\mathbf{39}_{a1}$ and $\mathbf{39}_{b1}$ are positioned in the proximity of the discharge port 30, the check valve assembly $\mathbf{35}_3$ and the bypass valve assemblies $\mathbf{40}_3$ are disposed close to each other. Also, because the two bypass valve assemblies $\mathbf{40}_3$ extend substantially in the same direction, respective portions thereof where the pressure of the refrigerant discharged from the first bypass holes $\mathbf{39}_{a1}$ distant from the discharge port 30 and the pressure of the refrigerant discharged from the second bypass holes $\mathbf{39}_{b1}$ closer to the discharge port 30 act are different from those shown in FIG. 18. In other words, considering the lever length, the two bypass valve assemblies $\mathbf{40}_3$ are subjected to different moments resulting from the pressure of the refrigerant discharged from the first and second bypass holes $\mathbf{39}_{a1}$ and $\mathbf{39}_{b1}$.

Accordingly, the reed valve $\mathbf{40}_{a3}$ of one of the bypass valve assemblies $\mathbf{40}_3$ has a length of l1 and a width W1, whereas that of the other of the bypass valve assemblies $\mathbf{40}_3$ has a different length of l2 and a different width W2 so that the two bypass valve assemblies $\mathbf{40}_3$ have different spring constants to open the bypass holes $\mathbf{39}_{a1}$ and $\mathbf{39}_{b1}$ substantially at the same timing.

Because the bypass holes $\mathbf{39}_{a1}$ and $\mathbf{39}_{b1}$ has a diameter smaller than that of the discharge port 30, the bypass valve assemblies $\mathbf{40}_3$ have a spring constant smaller than that of the check valve assembly $\mathbf{35}_3$ to facilitate the opening of the bypass valve assemblies $\mathbf{40}_3$, achieving the bypass action effectively.

The scroll refrigerant compressor of the above-described construction operates as follows.

In FIGS. 26 to 28, if liquid compression occurs in the first compression chamber 2*a* communicating intermittently with the suction chamber 31, the auxiliary bypass valve assemblies $\mathbf{42}_3$ closing the auxiliary bypass holes 49 and the reed valves $\mathbf{40}_{a3}$ of the bypass valve assemblies $\mathbf{40}_3$ closing the first and second bypass holes $\mathbf{39}_{a1}$ and $\mathbf{39}_{b1}$ are successively opened to discharge the refrigerant into the discharge chamber 32, thus reducing the pressure inside the compression chambers.

Furthermore, because the auxiliary bypass valve assemblies $\mathbf{42}_3$, the bypass valve assemblies $\mathbf{40}_3$, and the check valve assembly $\mathbf{35}_3$ are of one-piece construction, when the bypass valve assemblies $\mathbf{40}_3$ susceptible to deformation are mounted on the stationary end plate $\mathbf{7}_{a3}$, the bypass valve assemblies $\mathbf{40}_3$ positively close the bypass holes $\mathbf{39}_{a1}$ and $\mathbf{39}_{b1}$ without deviating therefrom.

On the other hand, if liquid compression occurs in the second compression chambers 2*b* communicating intermittently with the discharge port 30, the bypass valve assemblies $\mathbf{40}_3$ closing the first and second bypass holes $\mathbf{39}_{a1}$ and $\mathbf{39}_{b1}$ open them to discharge the refrigerant into the discharge chamber 32, thus reducing the pressure inside the compression chambers.

Because the first and second bypass holes $\mathbf{39}_{a1}$ and $\mathbf{39}_{b1}$ are positioned so as not to be closed simultaneously by the free end of the orbiting scroll wrap 13*a*, the successive opening of the bypass valve assemblies $\mathbf{40}_3$ is ensured.

The opening of the auxiliary bypass valve assemblies $\mathbf{42}_3$ and the bypass valve assemblies $\mathbf{40}_3$ is not limited to the case in which the liquid compression occurs in the compression chambers 2. That is, as shown in FIG. 10, the suction pressure in the ordinary refrigerating cycle operation is reduced as the compressor speed increases. On the other hand, the discharge pressure generally increases, resulting in an increase in compression ratio.

Accordingly, the compression ratio of a compressor with no auxiliary bypass valve assemblies and no bypass valve assemblies at low speed operations is smaller than the compression ratio set under the rated load operating condition, giving rise to an excessive compression condition as shown by oblique lines in FIG. 11.

Even in such a case, the reed valves $\mathbf{40}_{a3}$ of the bypass valve assemblies $\mathbf{40}_3$ closing the first and second bypass holes $\mathbf{39}_{a1}$ and $\mathbf{39}_{b1}$ are opened to discharge the refrigerant into the discharge chamber 32. As a result, as shown by a double-dotted chain line 99 in FIG. 11, the pressure inside the compression chambers 2 is reduced on the way to thereby lighten the compression load.

The opening of the first bypass holes $\mathbf{39}_{a1}$ distant from the discharge port 30 causes the opening of the second bypass holes $\mathbf{39}_{b1}$ closer to the discharge port 30. This brings about a smooth bypass action from the second compression chambers 2*b*, making it possible to reduce the input power.

Figure 30:
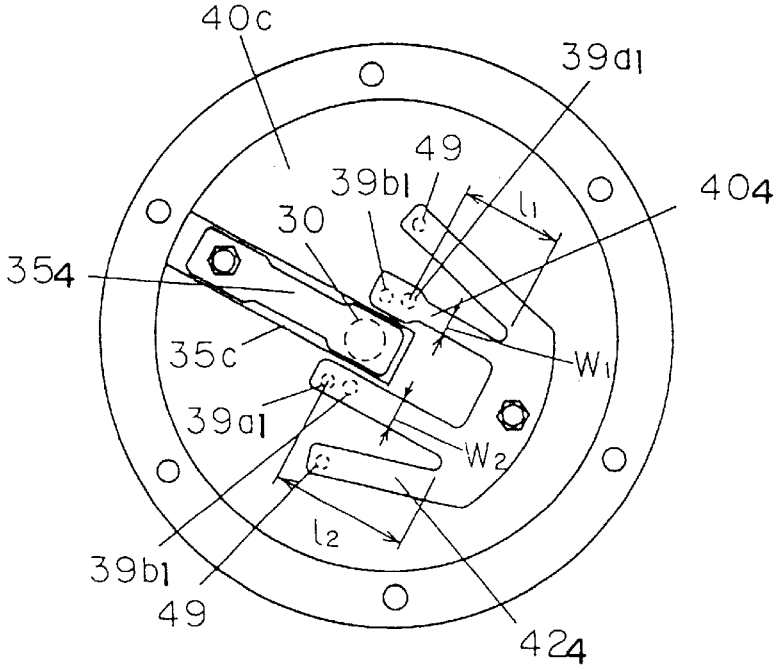
FIG. 30 is a view similar to FIG. 25, but depicting the stationary scroll mounted in the scroll refrigerant compressor of FIG. 29.
Figure 29:
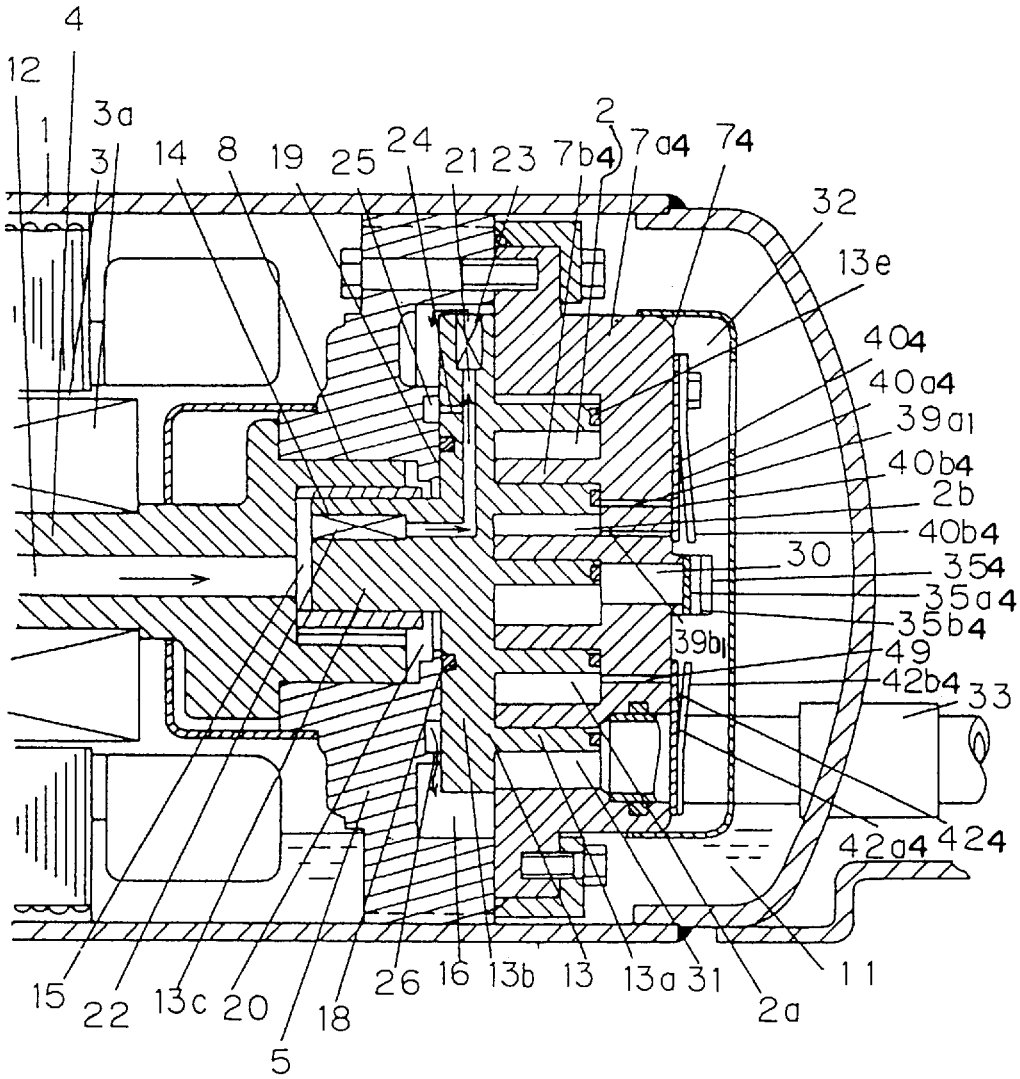
FIG. 29 is a fragmentary vertical sectional view of a scroll refrigerant compressor according to a ninth embodiment of the present invention.

FIGS. 29 and 30 depict a scroll refrigerant compressor according to a ninth embodiment of the present invention.

As shown in FIG. 29, a stationary end plate $\mathbf{7}_{a4}$ has two planes different in height, on one of which a check valve assembly $\mathbf{35}_4$ is mounted and on the other of which bypass valve assemblies $\mathbf{40}_4$ and auxiliary bypass valve assemblies $\mathbf{42}_4$ are mounted. A valve seat 35*c* for the check valve assembly $\mathbf{35}_4$ is higher than a valve seat 40*c* for both the bypass valve assemblies $\mathbf{40}_4$ and the auxiliary bypass valve assemblies $\mathbf{42}_4$. The bypass valve assemblies $\mathbf{40}_4$ and the auxiliary bypass valve assemblies $\mathbf{42}_4$ extend substantially in the same direction and are formed integrally with each other.

As in the previous embodiment, one of the bypass valve assemblies $\mathbf{40}_4$ has a length of l1 and a width W1, whereas the other of the bypass valve assemblies $\mathbf{40}_4$ has a different length of l2 and a different width W2, thereby allowing the two bypass valve assemblies $\mathbf{40}_4$ to have different spring constants but to open the bypass holes $\mathbf{39}_{a1}$ and $\mathbf{39}_{b1}$ substantially at the same timing. The two bypass valve assemblies $\mathbf{40}_4$ are disposed on respective sides of the check valve seat 35*c* in the proximity of opposite side walls thereof. The shape of the bypass valve assemblies $\mathbf{40}_4$ is determined to enhance the positioning accuracy during assembling.

In the above-described construction, after the bypass valve assemblies $\mathbf{40}_4$ have been opened, the check valve assembly $\mathbf{35}_4$ starts opening slightly by the action of the pressure of the refrigerant gas flowing out from the second compression chambers 2*b*. This opening assists a smooth outflow of the refrigerant gas discharged after the second compression chambers 2*b* have communicated with the discharge port 30, thus reducing an excessive compression inside the discharge port 30.

Under the condition in which the bypass valve assemblies $\mathbf{40}_4$ are not opened, they are not adversely affected by the diffusion of an air current when the refrigerant gas is discharged from the discharge port 30 to the discharge chamber 32. Accordingly, the bypass valve assemblies $\mathbf{40}_4$ positively close the bypass holes 39, thus preventing a reduction in compression efficiency which has been hitherto caused by the refrigerant gas in the discharge chamber 32 flowing back into the second compression chambers 2*b* through the bypass holes 39.

It is to be noted here that although in the above-described embodiment the check valve seat 35*c* is integrally formed with the stationary end plate $\mathbf{7}_{a4}$, the former may be made of a member separate from the latter.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A scroll compressor comprising:

a closed vessel having a discharge chamber defined therein;

a stationary scroll accommodated in said closed vessel and having a stationary end plate and a stationary scroll wrap protruding axially from said stationary end plate, said stationary scroll also having a discharge port defined therein at a central portion thereof and a suction chamber formed outside said stationary scroll wrap;

an orbiting scroll accommodated in said closed vessel and having an orbiting end plate and an orbiting scroll wrap protruding axially from said orbiting end plate so as to engage with said stationary scroll wrap to define a plurality of compression chambers therebetween;

an electric motor for driving said drive shaft;

a frame rotatably supporting said drive shaft, said stationary scroll being secured to said frame;

a rotation prevention member for preventing rotation of said orbiting scroll about its own axis;

a check valve for selectively opening and closing said discharge port and allowing a fluid to flow only from said discharge port towards said discharge chamber;

said stationary end plate having at least two first bypass holes defined therein at locations symmetrical in terms of pressure, said two first bypass holes being open to ones of said compression chambers closest to said discharge port, and said two first bypass holes being in communication with said discharge chamber;

a bypass valve for selectively opening and closing said first bypass holes and allowing the fluid to flow only from said compression chambers towards said discharge chamber through said first bypass holes; and said first bypass holes being positioned so that no portion of any of said first bypass holes is closed by said orbiting scroll wrap immediately after said compression chambers closest to said discharge port have communicated with said discharge port.

2. The scroll compressor according to claim 1, further comprising an oil sump defined in said closed vessel and subjected to a discharge pressure, and an oil passage communicating said oil sump with at least one of said compression chambers and said suction chamber, wherein said first bypass holes are circumferentially positioned between said discharge port and a location where lubricating oil in said oil sump is introduced into one of said compression chambers and said suction chamber and wherein all of said plurality of compression chambers communicate intermittently with one of said discharge port and said suction chamber.

3. The scroll compressor according to claim 2, wherein said stationary end plate also has at least two second bypass holes defined therein symmetrically with respect to said discharge port, said first and second bypass holes being positioned so as not to be closed simultaneously by said orbiting scroll wrap.

4. The scroll compressor according to claim 2, further comprising a sealing member loosely received in a scroll-shaped groove defined in a free end of said orbiting scroll wrap, wherein said stationary end plate also has at least two second bypass holes defined therein symmetrically with respect to said discharge port, and wherein sizes and positions of said first and second bypass holes are determined so that said first and second bypass holes are not simultaneously closed by said sealing member.

5. The scroll compressor according to claim 2, wherein said stationary end plate has a bypass discharge chamber defined therein and accommodating said bypass valve, said bypass discharge chamber communicating on one side thereof with said first bypass holes and on the other side thereof with said discharge chamber through a bypass passage, and wherein when the fluid being compressed passes through said bypass valve, the fluid in said bypass discharge chamber causes said check valve to open said discharge port and is discharged into said discharge chamber though said bypass passage.

6. The scroll compressor according to claim 1, wherein said bypass valve comprises a ring-shaped bypass valve encircling said discharge port, and wherein said stationary end plate has a bypass discharge chamber defined therein and accommodating said bypass valve, said bypass discharge chamber encircling said discharge port and communicating on one side thereof with said first bypass holes and on the other side thereof with said discharge chamber.

7. The scroll compressor according to claim 6, wherein said bypass valve opens or closes said first bypass holes simultaneously.

8. The scroll compressor according to claim 6, further comprising a spring biasing said bypass valve toward closing of said first bypass holes, said spring having shape memory properties with which said spring increases a biasing force thereof with an increase of a temperature thereof, while said spring reduces the biasing force thereof with a reduction of the temperature thereof.

9. The scroll compressor according to claim 1, wherein all of said plurality of compression chambers communicate intermittently with one of said discharge port and said suction chamber, and wherein no portion of any of said first bypass holes is closed by said orbiting scroll wrap immediately before said compression chambers closest to said discharge port communicate with said discharge port and when said orbiting scroll has advanced 150° therefrom.

10. The scroll compressor according to claim 9, wherein said stationary end plate has at least two second bypass holes defined therein at locations symmetrical in terms of pressure and each of said second bypass holes is positioned close to one of said first bypass holes, and wherein said bypass valve comprises a single bypass valve for simultaneously opening or closing at least one of said first bypass holes and a neighboring one of said second bypass holes.

11. The scroll compressor according to claim 9, wherein said check valve serves as said bypass valve.

12. The scroll compressor according to claim 10, wherein said check valve serves as said bypass valve.

13. The scroll compressor according to claim 9, further comprising an auxiliary bypass valve for selectively opening and closing at least two auxiliary bypass holes defined in said stationary end plate, each of said auxiliary bypass holes being positioned between a location where a corresponding one of said first bypass holes closest to said discharge port is positioned and another location spaced circumferentially outwardly less than 360° therefrom, and within a range of less than 360° from a start of compression.

14. The scroll compressor according to claim 10, further comprising an auxiliary bypass valve for selectively opening and closing at least two auxiliary bypass holes defined in said stationary end plate, each of said auxiliary bypass holes being positioned between a location where a corresponding one of said first and second bypass holes closest to said discharge port is positioned and another location spaced circumferentially outwardly less than 360° therefrom, and within a range of less than 360° from a start of compression.

15. The scroll compressor according to claim 9, wherein said stationary end plate has at least two auxiliary bypass holes defined in said stationary end plate, each of said auxiliary bypass holes being spaced circumferentially from a corresponding one of said first bypass holes, said stationary end plate also having injection holes defined therein and communicating with a pressure reducing device that reduces a pressure of a liquid refrigerant in a refrigerating cycle, each of said injection holes being circumferentially positioned between the corresponding one of said first bypass holes and a corresponding one of said auxiliary bypass holes so that said injection holes can be entirely opened and closed by said orbiting scroll wrap.

16. The scroll compressor according to claim 12, wherein said stationary end plate has at least two auxiliary bypass holes defined in said stationary end plate, each of said auxiliary bypass holes being spaced circumferentially from a corresponding one of said first bypass holes, said stationary end plate also having injection holes defined therein and communicating with a pressure reducing device that reduces a pressure of a condensate in a refrigerating cycle, each of said injection holes being circumferentially positioned between the corresponding one of said first bypass holes and a corresponding one of said auxiliary bypass holes so that said injection holes can be entirely opened and closed by said orbiting scroll wrap.

17. The scroll compressor according to claim 15, further comprising a refrigerant injection pipe communicating said injection holes with said pressure reducing device, and a valve mounted on said refrigerant injection pipe, wherein said valve is opened when a compression ratio during operation of the compressor is greater than a predetermined compression ratio, while said valve is closed when the compression ratio during operation of the compressor is smaller than the predetermined compression ratio.

18. The scroll compressor according to claim 1, further comprising an oil sump defined in said closed vessel and subjected to a discharge pressure, and an oil passage communicating said oil sump with at least one of said compression chambers and said suction chamber, wherein said stationary end plate has a bypass discharge chamber defined therein at a location between said compression chambers and said check valve and accommodating said bypass valve, said bypass discharge chamber communicating on one side thereof with said first bypass holes and on the other side thereof with said discharge chamber, said bypass valve allowing the fluid to flow only from said compression chambers towards said bypass discharge chamber, and wherein when said bypass valve is opened, a valve body of said check valve is pushed up to thereby open said discharge port.

19. The scroll compressor according to claim 1, further comprising an oil sump defined in said closed vessel and subjected to a discharge pressure, and an oil passage communicating said oil sump with at least one of said compression chambers and said suction chamber, wherein said stationary end plate has a bypass discharge chamber defined therein at a location between said compression chambers and said check valve and accommodating a bypass valve having a reed valve body, said bypass discharge chamber communicating on one side thereof with said first bypass holes and on the other side thereof with said discharge chamber, said bypass valve allowing the fluid to flow only from said compression chambers towards said bypass discharge chamber, and wherein said reed valve body has a head portion encircling said discharge port so as to simultaneously open or close said first bypass holes.

20. The scroll compressor according to claim 1, further comprising an oil sump defined in said closed vessel and subjected to a discharge pressure, and an oil passage communicating said oil sump with at least one of said compression chambers and said suction chamber, wherein said bypass valve and said check valve are of one-piece construction and comprise respective reed valve bodies close to each other, said reed valve body of said bypass valve having a spring constant smaller than that of said reed valve body of said check valve.

21. The scroll compressor according to claim 20, wherein said reed valve body of said bypass valve and said reed valve body of said check valve extend substantially in the same direction.

22. The scroll compressor according to claim 1, further comprising an oil sump defined in said closed vessel and subjected to a discharge pressure, and an oil passage communicating said oil sump with at least one of said compression chambers and said suction chamber, wherein said bypass valve and said check valve comprise respective reed valve bodies close to each other, and wherein a valve seat for said check valve is higher than a valve seat for said bypass valve.

23. The scroll compressor according to claim 22, wherein said bypass valve comprises a plurality of bypass valves integrally connected together and disposed on respective sides of said valve seat for said check valve at locations close thereto.

24. The scroll compressor according to claim 21, wherein said stationary end plate has at least two second bypass holes defined therein, wherein said bypass valve comprises two valve bodies having different spring constants so that those bypass holes of said first and second bypass holes that are open to the same compression chamber are opened or closed simultaneously by a corresponding one of said two valve bodies.

25. The scroll compressor according to claim 22, wherein said stationary end plate has at least two second bypass holes defined therein, wherein said bypass valve comprises two valve bodies having different spring constants so that those bypass holes of said first and second bypass holes that are open to the same compression chamber are opened or closed simultaneously by a corresponding one of said two valve bodies.

26. The scroll compressor according to claim 23, wherein said stationary end plate has at least two second bypass holes defined therein, wherein said bypass valve comprises two valve bodies having different spring constants so that those bypass holes of said first and second bypass holes that are open to the same compression chamber are opened or closed simultaneously by a corresponding one of said two valve bodies.

27. The scroll compressor according to claim 1, wherein all bypass holes opening into said compression chambers closest to said discharge port are free from even partial closure by said orbiting scroll wrap immediately after said compression chambers closest to said discharge port have communicated with said discharge port.

* * * * *